US009329518B2

(12) United States Patent
Saito et al.

(10) Patent No.: US 9,329,518 B2
(45) Date of Patent: May 3, 2016

(54) IMAGE FORMING APPARATUS

(71) Applicant: KYOCERA Document Solutions Inc., Osaka (JP)

(72) Inventors: Yosuke Saito, Osaka (JP); Nobuyuki Hayashi, Osaka (JP); Takahiko Murata, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 14/693,172

(22) Filed: Apr. 22, 2015

(65) Prior Publication Data

US 2015/0309450 A1 Oct. 29, 2015

(30) Foreign Application Priority Data

Apr. 23, 2014 (JP) ..... 2014-088818
Apr. 23, 2014 (JP) ..... 2014-088819
May 26, 2014 (JP) ..... 2014-108052

(51) Int. Cl.
*G03G 15/01* (2006.01)
*G03G 21/08* (2006.01)

(52) U.S. Cl.
CPC ..... *G03G 15/0136* (2013.01); *G03G 15/0189* (2013.01); *G03G 21/08* (2013.01)

(58) Field of Classification Search
CPC ..... G03G 15/1645; G03G 21/08; G03G 15/0136; G03G 15/0189
USPC ..... 399/128
See application file for complete search history.

(56) References Cited

U.S. PATENT DOCUMENTS 8,660,464 B2 2/2014 Ishino et al.
2011/0249987 A1* 10/2011 Ishino ..... G03G 21/06 399/128
2014/0139607 A1* 5/2014 Hayashi ..... G03G 15/04054 347/224

FOREIGN PATENT DOCUMENTS

JP 2011-221405 A 11/2011

* cited by examiner

*Primary Examiner* — David Bolduc
*Assistant Examiner* — Barnabas Fekete
(74) *Attorney, Agent, or Firm* — Studebaker & Brackett PC

(57) ABSTRACT

An image forming apparatus includes image forming units, static eliminating sections, a mode switching section, and an exposure switching section. The static eliminating sections outputs first and second light. The mode switching section switches a state a between a first mode in which all of the image forming units are operated and a second mode in which only a first image forming unit is operated. In a second image forming unit located upstream next to the first image forming unit, the exposure switching section causes the image bearing member of the second image forming unit not to be irradiated with the first light and causes the image bearing member of the first image forming unit to be irradiated with the second light in the second mode.

19 Claims, 16 Drawing Sheets

IMAGE FORMING APPARATUS

INCORPORATION BY REFERENCE

The present application claims priority under 35 U.S.C. §119 to Japanese Patent Application Nos. 2014-088818 and 2014-088819, filed Apr. 23, 2014 and No. 2014-108052, filed May 26, 2014. The contents of this application are incorporated herein by reference in their entirety.

BACKGROUND

The present disclosure relates to tandem image forming apparatuses.

Typically known tandem image forming apparatuses include a plurality of image forming units arranged along an endless intermediate transfer belt that circulates. Each image forming unit included in such a tandem image forming apparatus includes, around a drum-shaped image bearing member (a photosensitive member) thereof, a charger, a development section, a primary transfer section, a static eliminating section, and a cleaning section. The image forming units form images (toner images) in different colors on a surface of the intermediate transfer belt in succession in a layered manner.

Hereinafter, a direction in which the intermediate transfer belt circulates in a direction where the image forming units are arranged in a tandem image forming apparatus will be referred to as a belt circulating direction.

The tandem image forming apparatus is capable of switching a mode of the image forming units between a multicolor mode and a monochrome color mode. In the multicolor mode, all of the image forming units are operated. In the monochrome color mode, only an image forming unit located the furthest downstream in terms of a belt circulation direction is operated.

It is also known in the tandem image forming apparatus that the static eliminating section of each of the image forming units has functions to irradiate post-transfer static eliminating light and to irradiate pre-transfer static eliminating light.

The post-transfer static eliminating light is static eliminating light with which a part of the image bearing member that has been subjected to image transfer is irradiated from between the transfer section and the cleaning section in each of the image forming units. By contrast, the pre-transfer static eliminating light is static eliminating light with which the image bearing member of an image forming unit located next downstream of a given image forming unit in terms of the belt circulating direction is irradiated from between the transfer section and the cleaning section of the given image forming unit.

SUMMARY

An image forming apparatus according to one aspect of the present disclosure includes a plurality of image forming units. The image forming units are arrange along an endless intermediate transfer belt that circulates. The image forming unites each include an image bearing member, a development section that develops an electrostatic latent image on a surface of the image bearing member, a primary transfer section that transfers an image to the intermediate transfer belt, and a cleaning section that cleans the surface of the image bearing member. The image forming units form respective images in different colors on the surface of the intermediate transfer belt in a superimposed manner. The image forming apparatus includes a plurality of static eliminating sections, a mode switching section, and a static elimination exposure switching section. The static eliminating sections are each provided in a corresponding one of the image forming units, and each output first static eliminating light traveling upstream in terms of a circulation direction of the intermediate transfer belt and second static eliminating light traveling downward in terms of the rotation direction of the intermediate transfer belt. The mode switching section selectively switches a state of the image forming units among a plurality of modes including a first mode in which all of the image forming units are operated and a second mode in which at least a portion of the image forming units is operated among the image forming units. The portion of the image forming units is at least one first image forming unit located on a downstream side in terms of the circulation direction of the intermediate transfer belt. In a second image forming unit located upstream next to the first image forming unit in terms of the circulation direction of the intermediate transfer belt, the static elimination exposure switching section causes the image bearing member of the second image forming unit to be irradiated with the first static eliminating light and causes the image bearing member of the first image forming unit is irradiated with the second static eliminating light in while the first mode is selected, and causes the image bearing member of the second image forming unit not to be irradiated with the first static eliminating light and causes the image bearing member of the first image forming unit to be irradiated with the second static eliminating light while the second mode is selected.

DETAILED DESCRIPTION

First Embodiment

Figure 1:
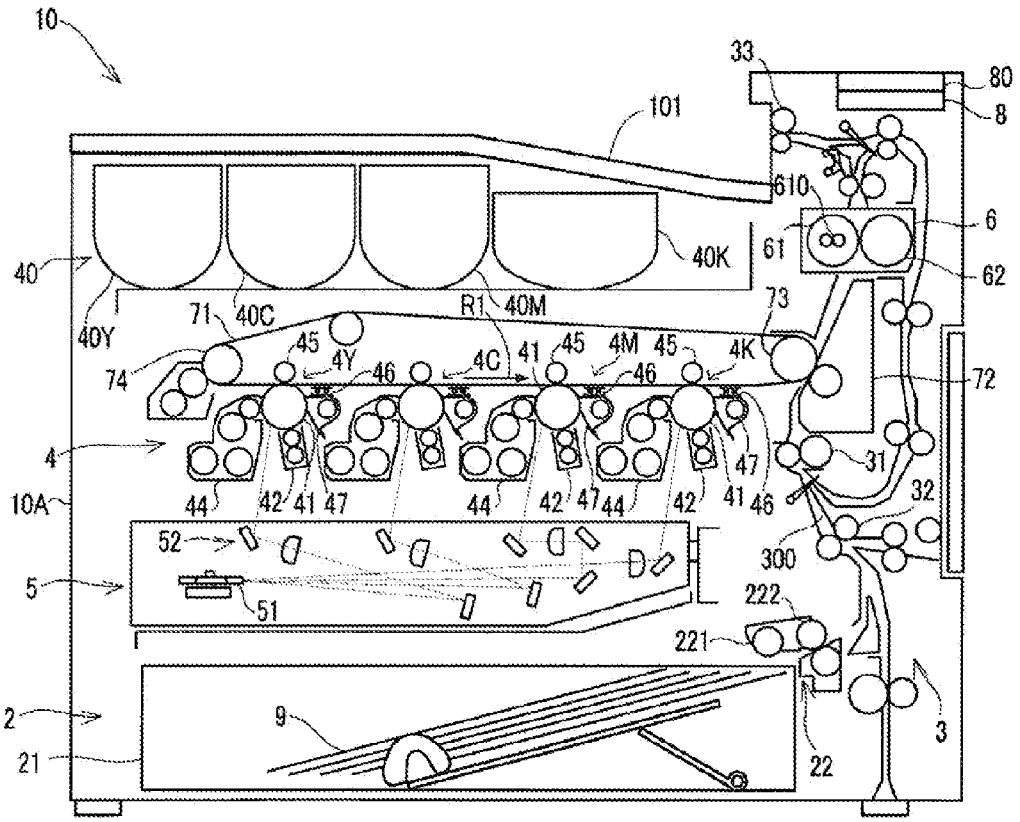
FIG. 1 illustrates a configuration of an image forming apparatus according to a first embodiment of the present disclosure.
Figure 4:
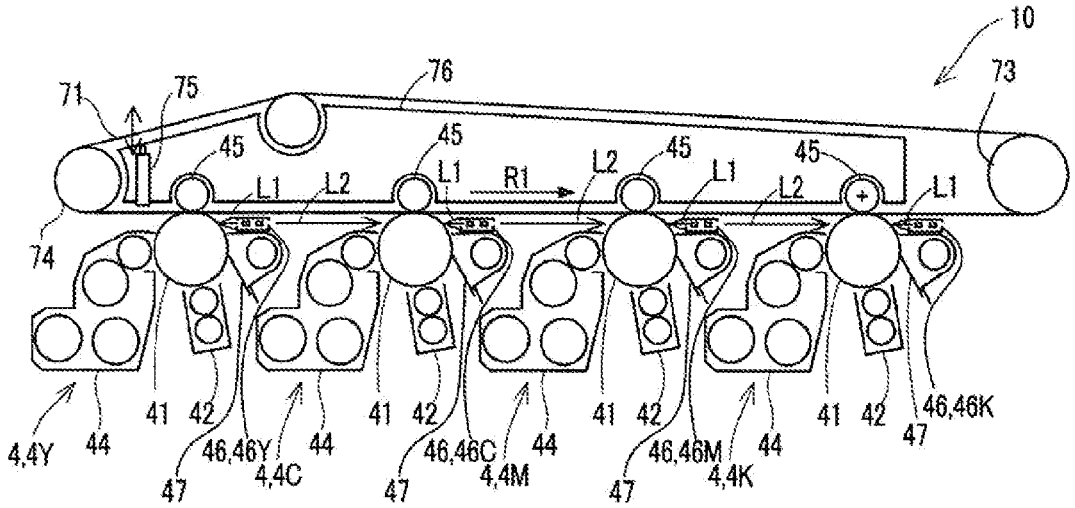
FIG. 4 is a schematic side view of image forming units of the image forming apparatus in a color mode according to the first embodiment of the present disclosure.
Figure 5:
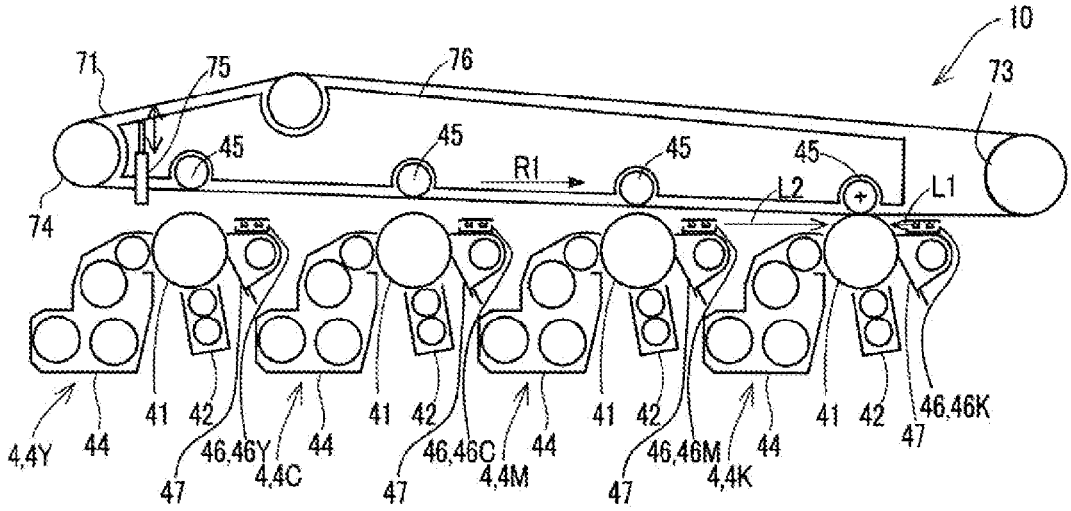
FIG. 5 is a schematic side view of the image forming units of the image forming apparatus in a monochrome mode according to the first embodiment of the present disclosure.

As illustrated in FIG. 1, an image forming apparatus 10 includes, within a casing 10A thereof, a sheet supply section 2, a sheet conveyance section 3, a plurality of developer containers 40, a plurality of image forming units 4, an optical scanning section 5, a fixing section 6, an intermediate transfer belt 71, a secondary transfer section 72, an operation display section 80, a control section 8, etc. The control section 8 is an example of a static elimination exposure switching section. As illustrated in FIGS. 4 and 5, the image forming apparatus 10 further includes a shift mechanism 75.

The sheet supply section 2 includes a sheet cassette 21 that is freely detachable from the casing 10A and a sheet feed section 22 that feeds recording sheets 9 accommodated in the sheet cassette 21 to the image forming units 4. The recording sheets 9 may be a sheet-like media on which an image is to be formed, such as paper, coated paper, postcards, envelopes, overhead projector sheets, or the like.

The sheet feed section 22 includes a pickup roller 221 and feed rollers 222. The sheet feed section 22 picks up the recording sheets P, one at a time, from the sheet cassette 21 and feeds the recording sheets 9 to a sheet conveyance path 300 of the sheet conveyance section 3.

The sheet conveyance section 3 includes registration rollers 31, conveyance rollers 32, ejection rollers 33, etc. The registration rollers 31 and the conveyance rollers 32 convey a recording sheet 9 along the sheet conveyance path 300. The ejection rollers 33 eject the recording sheet 9 subjected to image formation in middle of the sheet conveyance path 300 onto an exit tray 101 from an exit port of the sheet conveyance path 300.

The respective developer containers 40 and the respective image forming units 4 are provided for respective developers (toners) of different colors. Reference signs Y, C, M, and K in the drawings indicate corresponding colors of yellow, cyan, magenta, and black of the developers, respectively. The color developers are each supplied to a corresponding one of the image forming units 4 from the corresponding developer container 40 that is freely detachable from the casing 10A.

The four image forming units 4 for the colors of the corresponding developers are arranged along the intermediate transfer belt 71 that is endless and circulates. The image forming units 4 form images (toner images) in different colors on a surface of the circulating intermediate transfer belt 71 in a superimposed manner.

The image forming units 4 each include a drum-shaped photosensitive member 41, a charger 42, a development section 44, a primary transfer section 45, a static eliminating section 46, a primary cleaning section 47, etc. The photosensitive member 41 is an example of an image bearing member.

The intermediate transfer belt 71 is an annular-shaped belt-like endless member. The intermediate transfer belt 71 circulates while being wound around a drive roller 73 and a driven roller 74. In the following description, a direction in which the intermediate transfer belt 71 circulates (moves) in a direction where the image forming units 4 are arranged will be referred to as a belt circulating direction R1.

In each of the image forming units 4, the photosensitive member 41 rotates at a peripheral speed according to a peripheral speed (moving speed) of the intermediate transfer belt 71 and the charger 42 charges the surface of the photosensitive member 41 uniformly.

The optical scanning section 5 that includes a laser light source (not illustrated), a polygon mirror 51, and a deflection optical device 52 scans laser light to write an electrostatic latent image onto the charged surface of the photosensitive member 41. The development section 44 then develops the electrostatic latent image into a toner image by supplying a toner (a developer) to the photosensitive member 41.

The primary transfer section 45 then transfers the toner image on the photosensitive member 41 to the surface of the intermediate transfer belt 71. The primary cleaning section 47 subsequently cleans the surface of the photosensitive member 41 in a manner to remove toner remaining on the surface of the photosensitive member 41.

The static eliminating section 46 is located between the primary transfer section 45 and the primary cleaning section 47. For example, the static eliminating section 46 is secured on a surface of the primary cleaning section 47 that is located on the side of the primary transfer section 45.

The static eliminating section 46 outputs first static eliminating light L1 and second static eliminating light L2.

The first static eliminating light L1 travels upstream in terms of the belt circulating direction R1 from between the primary transfer section 45 and the primary cleaning section 47. By contrast, the second static eliminating light L2 travels downstream in terms of the belt circulating direction R1 from between the primary transfer section 45 and the primary cleaning section 47.

Figure 2:
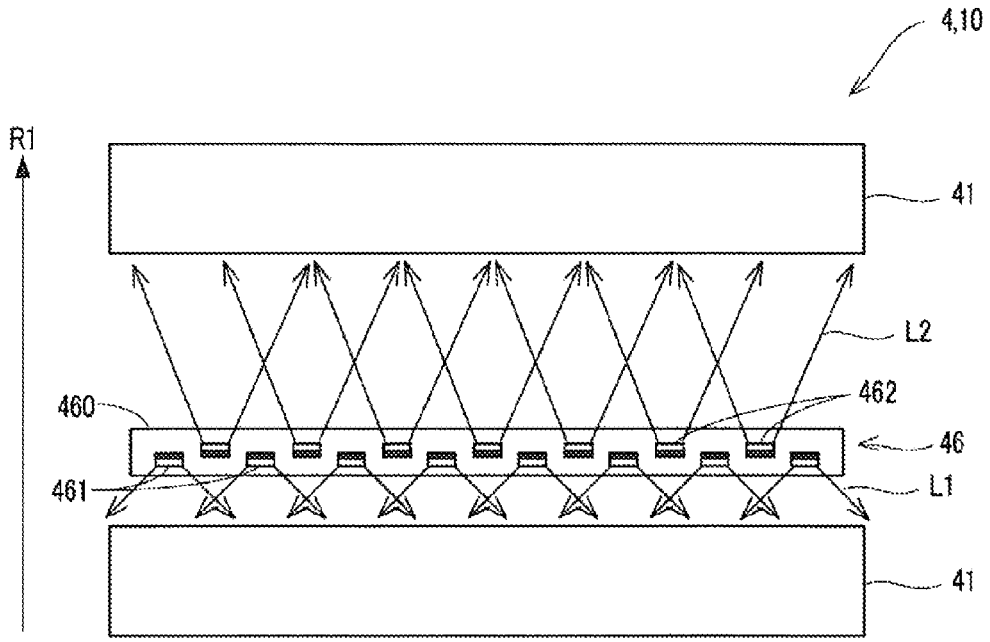
FIG. 2 is a schematic plan view of a static eliminating section in the image forming apparatus according to the first embodiment of the present disclosure.

As illustrated in FIG. 2, the static eliminating section 46 includes a first static eliminating light source 461 for the first static eliminating light L1 and a second static eliminating light source 462 for the second static eliminating light L2. The first and second static eliminating light sources 461 and 461 are mounted on a substrate 460. The first static eliminating light source 461 outputs the light upstream in terms of the belt circulating direction R1. The second static eliminating light source 462 outputs the light downstream in terms of the belt circulating direction R1. The first and second static eliminating light sources 461 and 462 are capable of turning on and off independently. The first and second static eliminating light sources 461 and 462 each include a plurality of light emitting diodes or the like arranged in terms of the axial direction of the photosensitive member 41, for example.

In each of the image forming units 4, the first static eliminating light L1 is post-transfer static eliminating light with which a part of the photosensitive member 41 is irradiated. The part of the photosensitive member 41 is located between a part thereof opposite to the primary transfer section 45 and a part thereof opposite to the primary cleaning section 47.

By contrast, the second static eliminating light L2 in each of the image forming units 4 is pre-transfer static eliminating light with which a part of the photosensitive member 41 of an image forming unit 4 located next downstream of a given image forming unit 4 in terms of the belt circulating direction R1 is irradiated. The part of the photosensitive member 41 of the next downstream image forming unit 4 is located between a part thereof opposite to the development section 44 and a part thereof opposite to the primary transfer section 45.

From the downstream side to the upstream side in terms of the belt circulating direction, a black image forming unit 4K, a magenta image forming unit 4M, a cyan image forming unit 4C, and a yellow image forming unit 4Y are arranged in this order.

In the configuration as above, the static eliminating section 46 of the yellow image forming unit 4Y irradiates the photosensitive member 41 of the next downstream cyan image forming unit 4C with the second static eliminating light L2 (pre-transfer static eliminating light). The static eliminating section 46 of the cyan image forming unit 4C irradiates the photosensitive member 41 of the next downstream magenta image forming unit 4M with the second static eliminating light L2. Also, the static eliminating section 46 of the magenta image forming unit 4M irradiates the photosensitive member 41 of the next downstream black image forming unit 4K with the second static eliminating light L2.

In a configuration in which the three photosensitive members 41 for the three colors of black, magenta, and cyan, which are comparatively conspicuous, are irradiated with the second static eliminating light L2 in addition to the first static eliminating light L1, transfer voltage of the corresponding primary transfer sections 45 can be reduced comparatively low. Thus, problems of image memory can be hardly caused.

The yellow image forming unit 4Y is located the furthest upstream in terms of the belt circulating direction R1 in the first embodiment. In the configuration as above, the photosensitive member 41 of the yellow image forming unit 4Y does not receive the second static eliminating light L2 (pre-transfer static eliminating light). A yellow image is not so conspicuous, and therefore, problems of image memory can hardly become manifest even if the photosensitive member 41 of the yellow image forming unit 4Y is not irradiated with the second static eliminating light L2.

Figure 3:
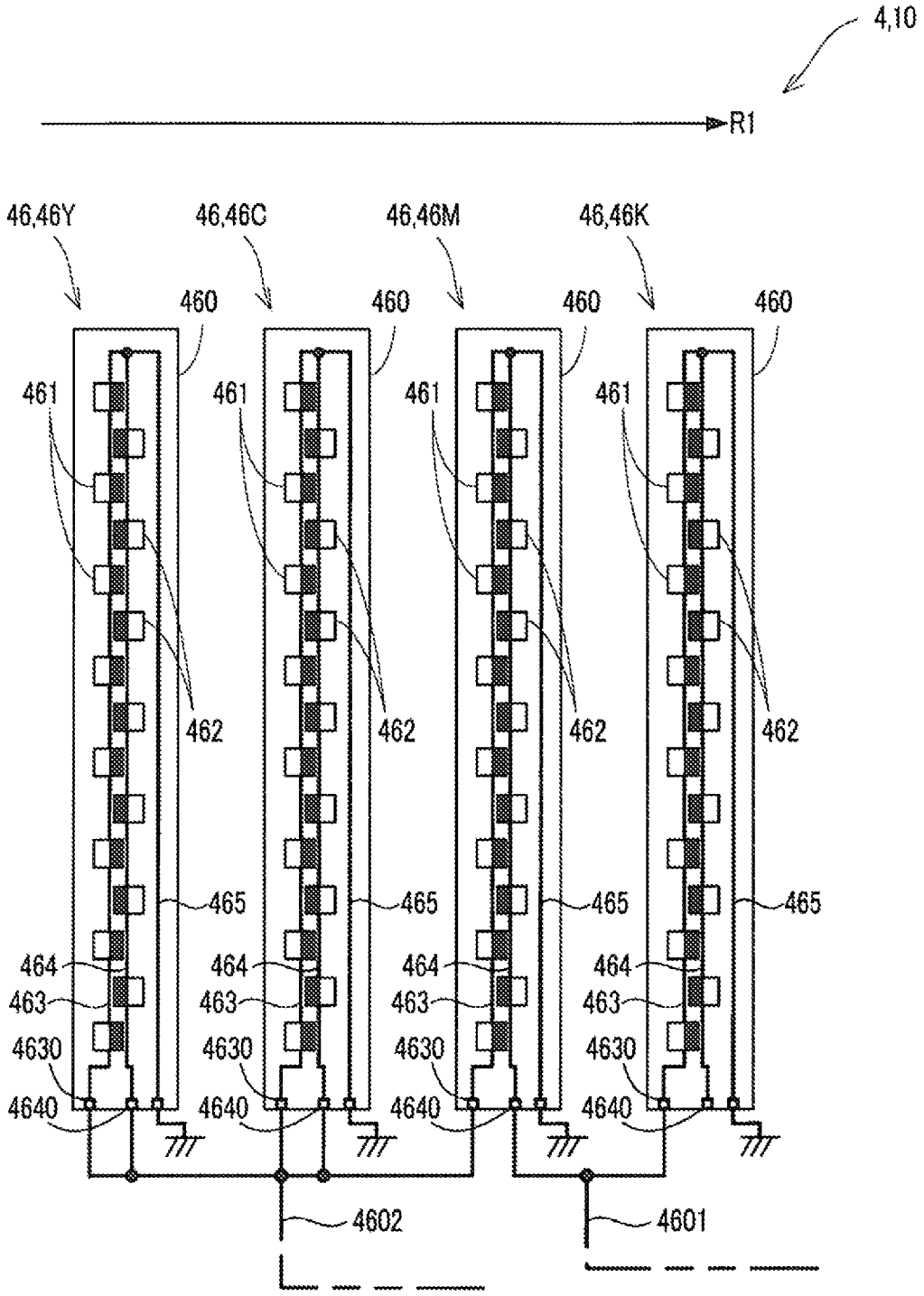
FIG. 3 is a circuit diagram illustrating a connection of static eliminating sections in the image forming apparatus according to the first embodiment of the present disclosure.

FIG. 3 illustrates an electric connection among the four static eliminating sections 46. As illustrated in FIG. 3, a first power supply line 463, a second power supply line 464, and a ground line 465 run on the substrate 460 of each of the static eliminating sections 46.

The first power supply line 463 supplies electric power to the first static eliminating light source 461. The second power supply line 464 supplies electric power to the second static eliminating light source 462. A first terminal 4630 serving as a connection terminal of the first power supply line 463 and a second terminal 4640 serving as a connection terminal of the second power supply line 464 are provided independently on the substrate 460. The ground line 465 connects the first and second power supply lines 463 and 464 to a grounded reference potential section.

The first power supply line 463 in the static eliminating section 46K for black and the second power supply line 464 in the static eliminating section 46M for magenta next to the static eliminating section 46K for black are electrically connected to a first drive line 4601 for static elimination. The first power supply line 463 in the static eliminating section 46M for magenta and the first and second static eliminating light sources 461 and 462 in the other of the static eliminating sections 46 except the black and magenta image forming units 4K and 4M are electrically connected to a second drive line 4602 for static elimination.

In other words, light source drive lines for the four static eliminating sections 46 are grouped into two lines of the first and second drive lines 4601 and 4602 for static elimination.

Note that the aforementioned first and second static eliminating light sources 461 and 462 in the other of the image forming units 4 correspond to the first and second static eliminating light sources 461 and 462 in the static eliminating sections for cyan and yellow, respectively, in the first embodiment.

The second power supply line 464 in the static eliminating section 46K for black is not electrically connected to any light source drive lines. In the configuration as above, the control section 8 cannot cause the second static eliminating light source 462 of the static eliminating section 46K for black to be turned on either in a color mode or a monochrome mode.

The secondary transfer section 72 having a roller shape transfers the image (toner image) transferred to the surface of the intermediate transfer belt 71 onto the recording sheet 9 that is moving along the sheet conveyance path 300.

The fixing section 6 sandwiches the recording sheet 9 on which the toner image is formed between a pressure roller 62 and a fixing roller 61 in which a heater 610, such as a halogen heater, is enclosed, and feeds the recording sheet 9 to the next process. Through the above, the fixing section 6 fixes the image onto the recording sheet 9 by applying heat to the toner image (image) on the recording sheet 9.

As illustrated in FIGS. 4 and 5, the shift mechanism 75 changes the positional relationship between the intermediate transfer belt 71 and the photosensitive members 41 (image bearing members). The shift mechanism 75 selectively switches a state of the image forming units 4 between a plurality of modes including a first mode and a second mode by changing the positional relationship. The first and second modes may be referred to as first and second color modes, respectively. Note that the shift mechanism 75 is an example of a mode switching section, which may be referred to as a color mode changing section also.

In the first embodiment, a color mode (first mode) is a mode in which the photosensitive members 41 of all of the image forming units 4 are in contact with the intermediate transfer belt 71 for operation, as illustrated in FIG. 4. By contrast, as illustrated in FIG. 5, a monochrome mode (second mode) is a mode in which the photosensitive member 41 of only the black image forming unit 4K located the furthest downstream in terms of the belt circulating direction R1 is in contact with the intermediate transfer belt 71 for operation. Note that the black image forming unit 4K and the magenta image forming unit 4M that is located next to the black image forming unit 4K in the first embodiment are examples of first and second image forming units, respectively.

For example, the shift mechanism 75 turns a supporting frame 76 that supports the driven roller 74 and the primary transfer sections 45 of the image forming units 4 (4Y, 4C, and 4M) except the black image forming unit 4K. In the configuration as above, the shift mechanism 75 turns the supporting frame 76 about the primary transfer section 45 of the black image forming unit 4K as a center thereof, for example. The shift mechanism 75 may be a solenoid actuator, for example.

The control section 8 causes an operation display section 80 to display an operation menu or the like and controls electric devices in the image forming apparatus 10 according to information input through the operation display section 80 and information detected by various sensors not illustrated.

Figure 6:
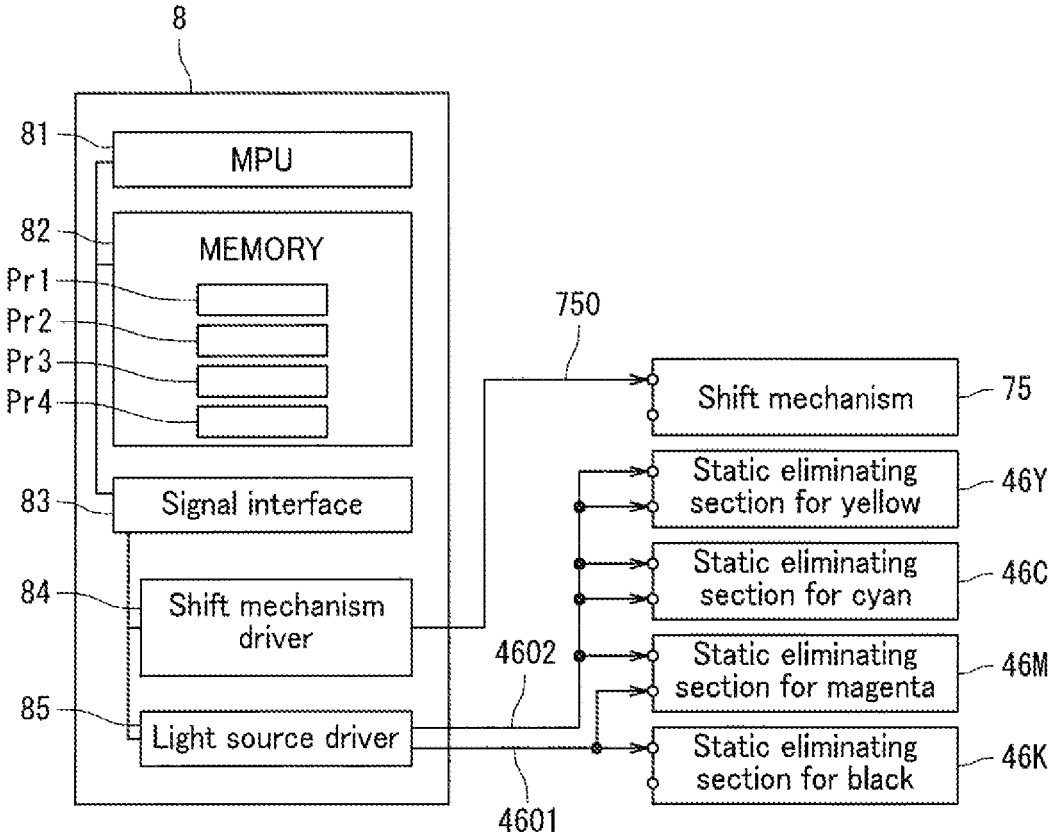
FIG. 6 is block diagram of elements pertaining to a control section of the image forming apparatus according to the first embodiment of the present disclosure.

The control section 8 controls electric devices in the image forming apparatus 10 including the static eliminating sections 46 and the shift mechanism 75. For example, the control section 8 includes a microprocessor unit (MPU) 81, a memory 82, a signal interface 83, a shift mechanism driver 84, and a light source driver 85, as illustrated in FIG. 6.

The MPU 81 is a processer that executes various types of arithmetic operations. The memory 82 serves as a nonvolatile storage section that stores in advance information including control programs Pr1, Pr2, Pr3, and Pr4 for causing the MPU 81 to execute various processing. The memory 82 also serves as a storage section from and into which the MPU 81 can read and write various information.

The control section 8 controls overall the image forming apparatus 10 by causing the memory MPU 81 to execute the control programs Pr1, Pr2, Pr3, and Pr4 stored in advance in the memory 82.

The signal interface 83 is an interface circuit that relays signals between the MPU 81 and sensors or devices targeted for control. The MPU 81 inputs detection signals (measurement signals) from various sensors via the signal interface 83.

The shift mechanism driver 84 is a circuit that outputs drive signals to the shift mechanism 75 via a drive line 750 according to the control signals output from the MPU 81 via the signal interface 83.

The light source driver 85 is a circuit that outputs light source drive signals to the static eliminating sections 46 according to the control signals output from the MPU 81 via the signal interface 83. The light source driver 85 is connected to each of the first and second drive lines 4601 and 4602 for static elimination. The light source driver 85 can output and stop outputting the light source drive signals independently to the first and second drive lines 4601 and 4602 for static elimination. In other words, the MPU 81 is capable of independently controlling output of the light source drive signals (power supply) to the respective first and second drive lines 4601 and 4602 for static elimination via the signal interface 83 and the light source driver 85.

Note that the control section 8 further includes additional circuits or drivers (not illustrated) that drive devices targeted for control besides the shift mechanism 75 and the static eliminating section 46. The MPU 81 controls the additional devices targeted for control via the signal interface 83 and additional drivers.

Figure 7:
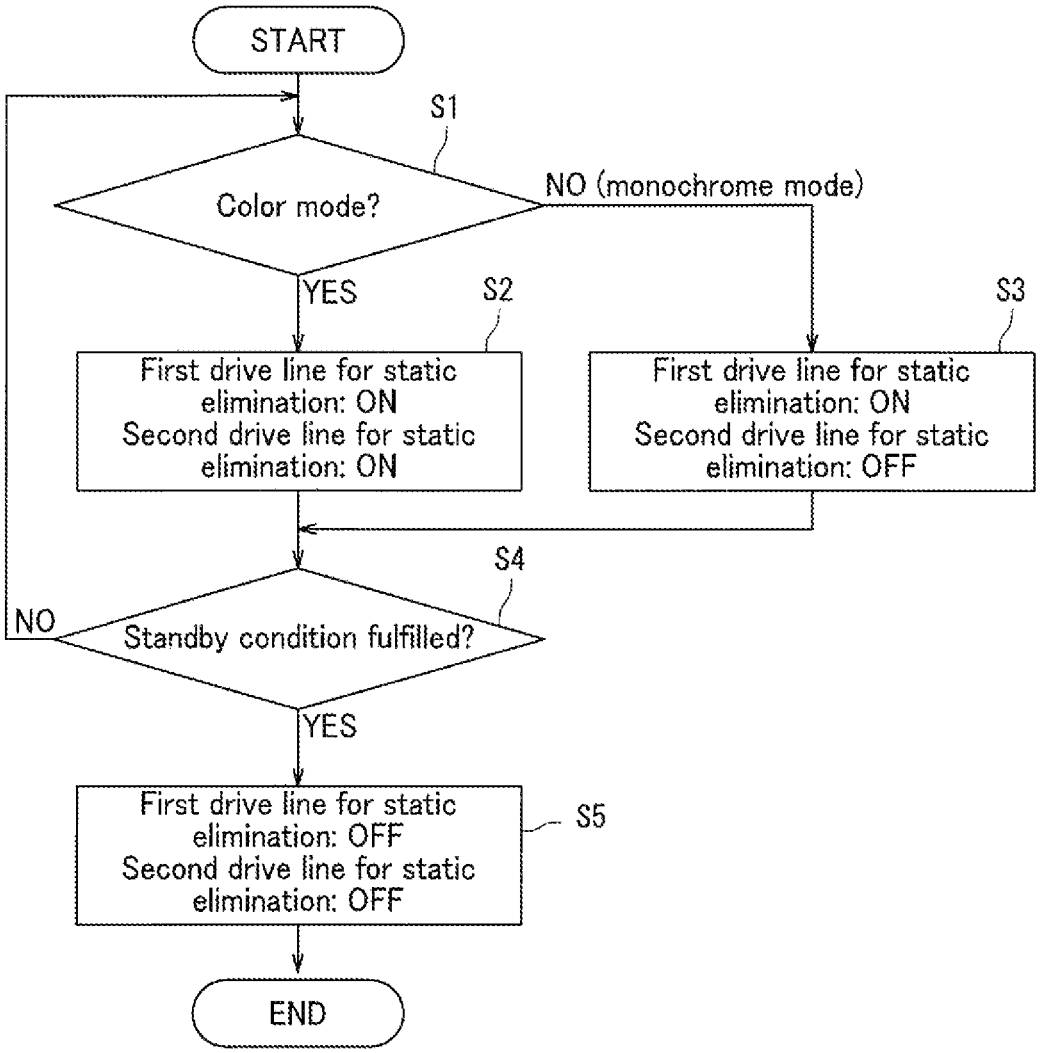
FIG. 7 is a flowchart depicting an example of a sequence of a static eliminating section control performed in the image forming apparatus according to the first embodiment of the present disclosure.

As will be described below, in a configuration with the static eliminating sections 46 having functions of both post-transfer static elimination and pre-transfer static elimination, the static elimination control as illustrated in FIG. 7 can prevent adverse influence of the first static eliminating light L1 from the static eliminating sections 46 on the photosensitive members 41 and prevent production of a defect in image quality caused by turning off of the static eliminating sections 46 in the image forming apparatus 10.

[Static Eliminating Section Control Method]

With reference to FIG. 7, an example of the static elimination control will be described that the control section 8 executes in the image forming apparatus 10. FIG. 7 is a flowchart depicting an example of a sequence of the static elimination control that the control section 8 executes.

The control section 8 starts the control illustrated in FIG. 7 upon a start of image formation by the image forming apparatus 10. In the following description, S1, S2, . . . are signs for identifying the sequence. Note that the processing by the control section 8 described below is realized in a manner that the MPU 81 executes control programs stored in the memory 82.

<Step S1>

First, the control section 8 determines which of the color mode or the monochrome mode is selected as the mode of the image forming units 4 by referencing information on an image formation job. At Step S1, the MPU 81 executes a determination program Pr8 stored in the memory 82.

<Step S2>

While the color mode is selected, the control section 8 outputs the light source drive signals to both the first and second drive lines 4601 and 4602 for static elimination. At Step S2, the MPU 81 executes a first static elimination control program Pr2 stored in the memory 82 as an example of a first static elimination control process.

Execution of Step S2 causes the first static eliminating light source 461 of the static eliminating section 46 for black and all of the first and second static eliminating light sources 461 and 462 of the static eliminating sections 46 of the other (4M, 4C, and 4Y) of the image forming units 4 to be turned on.

Note that ON and OFF in FIG. 7 indicate output and stop of the output of the light source drive signals to the first and second drive lines 4601 and 4602 for static elimination, respectively.

<Step S3>

By contrast, while the monochrome mode is selected, the control section 8 outputs the light source drive signals to only the first drive line 4601 for static elimination. The control section 8 accordingly stops outputting the light source drive signals to the second drive line 4602 for static elimination. At step S3, the MPU 81 executes a second static elimination control program Pr3 stored in the memory 82 as an example of a second static elimination control process.

Execution of Step S3 causes only the first static eliminating light source 461 of the static eliminating section 46K for black and the second static eliminating light source 462 of the next static eliminating section 46M for magenta to be turned on and causes the other of the static eliminating light sources to be turned off.

<Step S4>

The control section 8 subsequently determines whether or not a prescribed standby condition is fulfilled. The standby condition may be such that a state in which no new image formation job is input continues until a specific time period elapses after termination of image formation, for example. At Step S4, the MPU 81 executes a determination program Pr8 stored in the memory 82.

The control section 8 then repeats processing through Steps S1 to S4 as described above until the standby condition is fulfilled. For example, each time a new image formation job is input or each time a specific time period elapses, the control section 8 executes the processing through Steps S1 to S4.

<Step S5>

Upon determination of the wait condition being fulfilled, the control section 8 stops outputting the light source drive signals to both the first and second drive lines 4601 and 4602 for static elimination and goes into the standby state. Note that a standby state is a state in which input of a new image formation job is monitored. At step S5, the MPU 81 executes a third static elimination control program Pr4 stored in the memory 82.

Execution of Step S5 causes both the first and second static eliminating light sources 461 and 462 to be in a turned off state in all of the static eliminating sections 46 for the corresponding colors.

As described above, while the color mode is selected, the control section 8 causes the first static eliminating light source 461 of the black image forming unit 4K and all of the first and second static eliminating light sources 461 and 462 of the other (4M, 4C, 4Y) of the image forming units 4 to be turned on (S2).

By contrast, while the monochrome mode is selected, the control section 8 causes the first static eliminating light source 461 of the black image forming unit 4K and the second static eliminating light source 462 of the static eliminating section 46M for magenta located next upstream of the black image forming unit 4K in terms of the belt circulating direction R1 (S3) to be turned on (S3).

While the monochrome mode is selected, the control section 8 further causes all of the first and second static eliminating light sources 461 and 462 of the other (4C, 4Y) of the image forming units 4 except the black and magenta image forming units 4K and 4M to be turned off (S3).

While the monochrome mode is selected in the image forming apparatus 10 as described above, the second static eliminating light source 462 of the magenta image forming unit 4M is turned on for pre-transfer static elimination on the black image forming unit 4K that is being operated. As a result, production of a defect in image quality due to the presence of transfer memory can be prevented in image formation in the monochrome mode.

Further, while the monochrome mode is selected, the first static eliminating light source 461 of the magenta image forming unit 4M is turned off. The configuration as above can prevent adverse influence of the first static eliminating light L1 on the photosensitive member 41 of the magenta image forming unit 4M during stop.

As has been described so far with reference to FIGS. 1-7, in the first embodiment, the control section 8 controls the shift mechanism 75 that shifts the supporting frame 76 and the first and second static eliminating light sources 461 and 462 in synchronization. In the configuration as above, when setting the shift mechanism 75 into the color mode, the control section 8 causes the first static eliminating light source 461 of the static eliminating section 46 in the black image forming unit 4K and the first and second static eliminating light sources 461 and 462 of the static eliminating sections 46 in the other image forming units 4M, 4C, 4Y for the three colors to be turned on.

By contrast, when setting the shift mechanism 75 into the monochrome mode, the control section 8 causes the first static eliminating light source 461 of the static eliminating section 46 in the black image forming unit 4K and the second static eliminating light source 462 of the static eliminating section 46 in the next magenta image forming unit 4M to be turned on and causes all of the first and second static eliminating light sources 461 and 462 of the other static eliminating sections 46 to be turned off.

In other words, while the color mode (first mode) is selected, the control section 8 causes the photosensitive member 41 of the magenta image forming unit 4M to be irradiated with the first static eliminating light L1 and causes the photosensitive member 41 of the black image forming unit 4K (first image forming unit) to be irradiated with the second static eliminating light L2 in the magenta image forming unit 4M (second image forming unit). By contrast, while the monochrome mode is selected, the control section 8 causes the photosensitive member 41 of the magenta image forming unit 4M not to be irradiated with the first static eliminating light L1 and causes the photosensitive member 41 of the black image forming unit 4K to be irradiated with the second static eliminating light L2 in the magenta image forming unit 4M. The control section 8 operating as above is an example of a static elimination exposure switching section.

Second Embodiment

Figure 8:
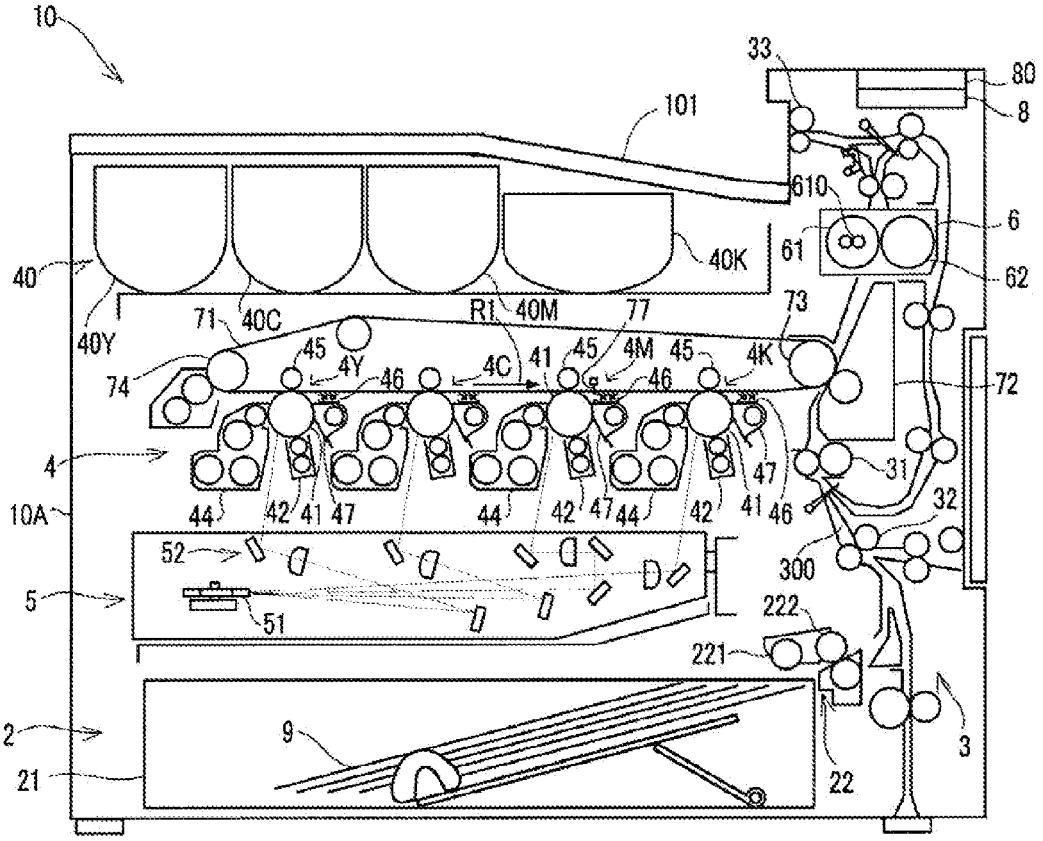
FIG. 8 illustrates a configuration of an image forming apparatus according to a second embodiment of the present disclosure.
Figure 10:
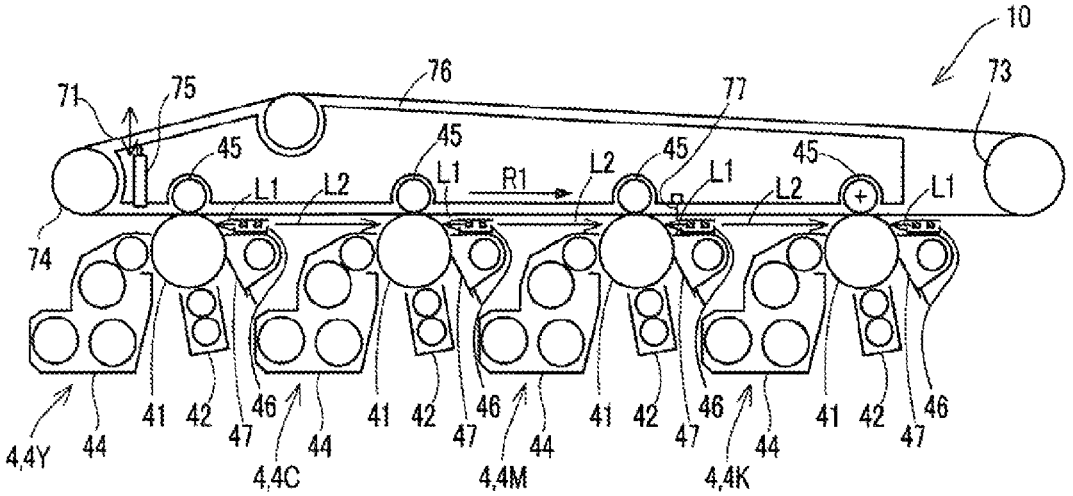
FIG. 10 is a schematic side view of image forming units and a light block switching section of the image forming apparatus in the color mode according to the second embodiment of the present disclosure.
Figure 12:
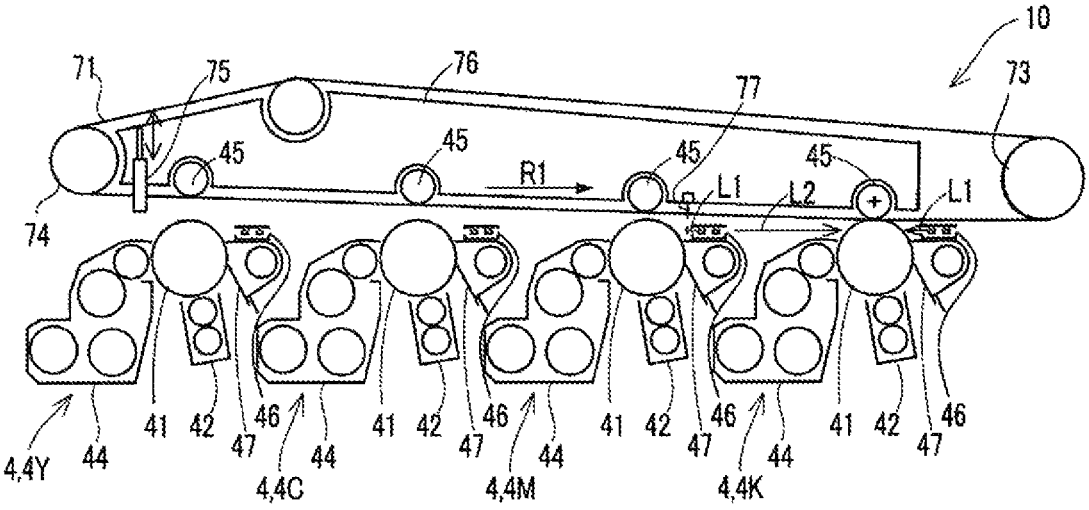
FIG. 12 is a schematic side view of the image forming units and the light block switching section of the image forming apparatus in the monochrome mode according to the second embodiment of the present disclosure.

As illustrated in FIGS. 8, 10, and 12, an image forming apparatus 10 according to a second embodiment further includes a light block switching section 77 in addition to the configuration of the image forming apparatus 10 in the first embodiment.

Figure 9:
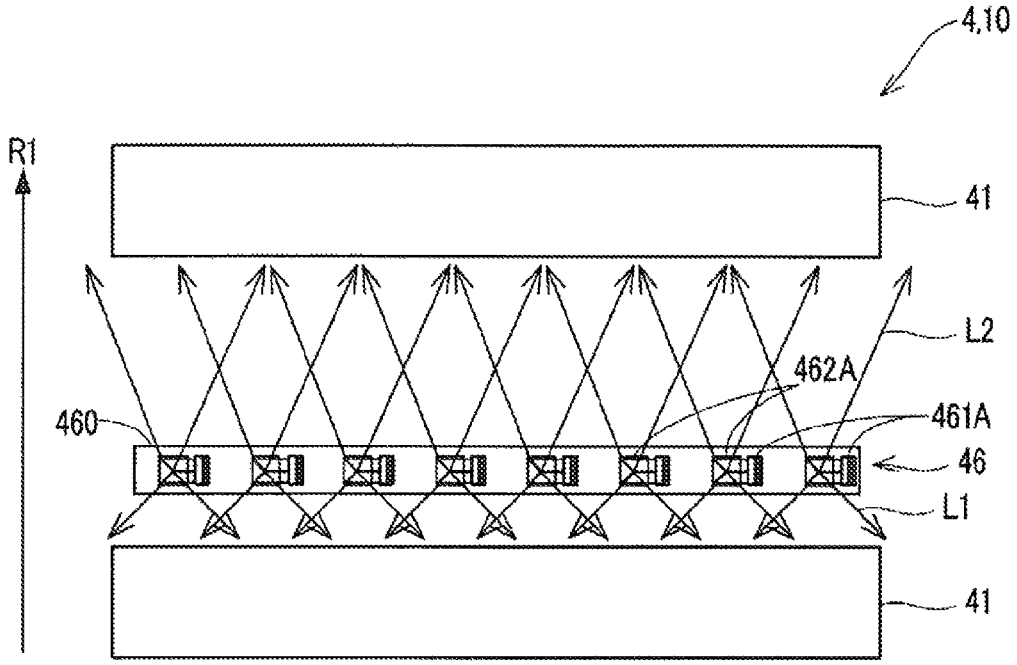
FIG. 9 is a schematic plan view of a static eliminating section of the image forming apparatus according to the second embodiment of the present disclosure.

In the example as illustrated in FIG. 9, the static eliminating sections 46 in the second embodiment each include a light source 461A and an optical splitter 462A each of which is mounted on the corresponding substrate 460. The optical splitter 462A splits emitted light (static eliminating light) from the light source 461A into the first static eliminating light L1 and the second static eliminating light L2. In the configuration as above, the light source 461A for the first static eliminating light L1 serves also as a light source for the second static eliminating light L2. In other words, the light source 461A is a common light source for the first and second static eliminating light L1 and L2 in each of the static eliminating sections 46. The light source 461A may include light emitting diodes, for example. The first and second static eliminating light L1 and L2 are defined in the same manner as those in the first embodiment.

In the second embodiment, description common to that in the first embodiment is omitted and the light block switching section 77, which is the difference from the first embodiment, will be discussed below. The configuration with the static eliminating sections 46 each having functions of both post-transfer static elimination and pre-transfer static elimination can prevent adverse influence of the first static eliminating light L1 from the static eliminating sections 46 on the photosensitive members 41 and production of a defect in image quality caused by turning off of the static eliminating sections 46.

The light block switching section 77 is capable of blocking the first static eliminating light L1 in the magenta image forming unit 4M located upstream next to the black image forming unit 4K, which is operated in the monochrome mode, in terms of the belt circulating direction R1.

More specifically, while the color mode is selected, the light block switching section 77 does not block the first static eliminating light L1 toward the photosensitive member 41 in the magenta image forming unit 4M. By contrast, while the monochrome mode is selected, the light block switching section 77 blocks the first static eliminating light L1 toward the photosensitive member 41 in the magenta image forming unit 4M.

Figure 11:
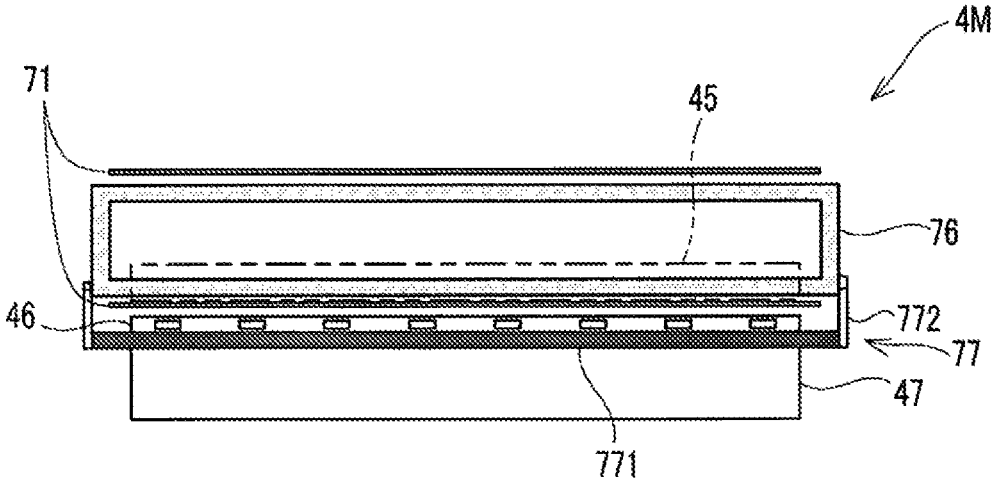
FIG. 11 is a front view of the light block switching section and section therearound in the image forming apparatus in the color mode according to the second embodiment of the present disclosure.
Figure 13:
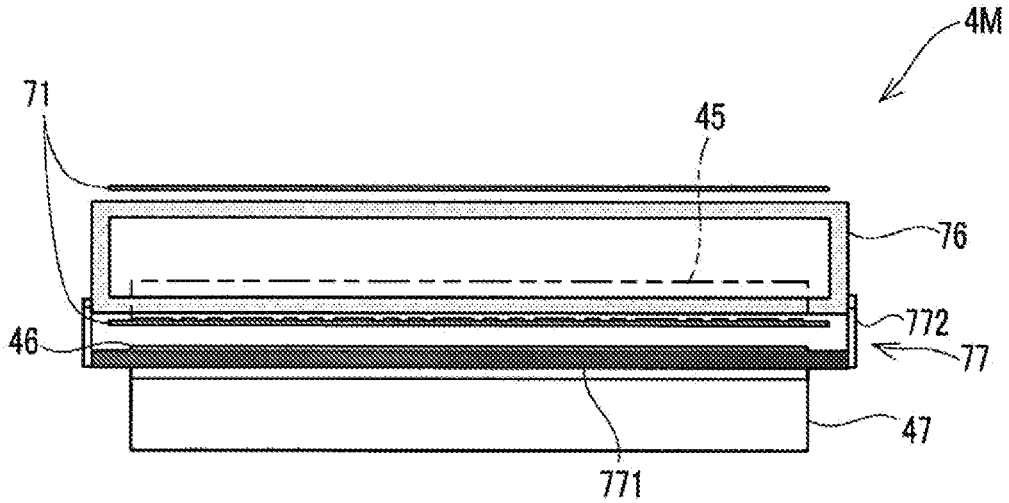
FIG. 13 is a front view of the light block switching section and section therearound in the image forming apparatus in the monochrome mode according to the second embodiment of the present disclosure.

FIGS. 11 and 13 are front views of the light block switching section 77 and section therearound in the color mode and the monochrome mode, respectively. The light block switching section 77 in the second embodiment includes a light blocking member 771 that blocks light and a joint 772 that joins the light blocking member 771 to the supporting frame 76.

Note that FIGS. 11 and 13 and FIGS. 14-15, which will be referred to later, illustrate a primary transfer section 45 drawn by imaginary lines (dashed and double dotted line) as well as each section of the intermediate transfer belt 71 and the supporting frame 76.

The light blocking member 771 is supported by the supporting frame 76 through the joint 772 such as to shift in association with the movement of the shift mechanism 75. More specifically, the light blocking member 771 shifts, in association with the movement of the shift mechanism 75, between the position to block the light path of the first static eliminating light L1 and the position not to block the light path of the first static eliminating light L1 in the magenta image forming unit 4M.

FIGS. 10 and 11 each illustrate a state in which the light blocking member 771 is located at a retracted position where the light blocking member 771 does not block the light path of the first static eliminating light L1. By contrast, FIGS. 12 and 13 each illustrate a state in which the light blocking member 771 is located at a blocking position where the light blocking member 771 blocks the light path of the first static eliminating light L1.

In the configuration as above, while the color mode is selected, the light block switching section 77 sets the image forming unit 4 (4M) located next downstream in terms of the belt circulating direction R1 such that the photosensitive member 41 of the image forming unit 4 (4M) is irradiated with the first static eliminating light L1 and the photosensitive member 41 of the furthest downstream image forming unit 4 (4K) in terms thereof is irradiated with the second static eliminating light L2.

By contrast, while the monochrome mode is selected, the light block switching section 77 sets the image forming unit 4 (4M) located next downstream in terms of the belt circulating direction R1 such that the photosensitive member 41 of the image forming unit 4 (4M) is not irradiated with the first static eliminating light L1 and the photosensitive member 41 of the most downstream image forming unit 4 (4K) in terms thereof is irradiated with the second static eliminating light L2. Note that the light block switching section 77 is an example of a static elimination exposure switching section.

As has been described so far, in the image forming apparatus 10 according to the second embodiment, the static eliminating section 46 of the magenta image forming unit 4M is turned on during the monochrome mode being selected, so that pre-transfer static elimination is performed on the black image forming unit 4K that is being operated. As a result, production of a defect in image quality due to the presence of transfer memory can be prevented in image formation in the monochrome mode.

Further, while the monochrome mode is selected, the first static eliminating light L1 from the static eliminating section 46 is blocked midway to the photosensitive member 41 in the magenta image forming unit 4M. The above configuration can accordingly prevent adverse influence of the first static eliminating light L1 on the photosensitive member 41 of the magenta image forming unit 4M of which operation is being stopped.

Third Embodiment

An image forming apparatus 10 according to a third embodiment of the present disclosure will be described next with reference to FIG. 14. The image forming apparatus 10 according to the third embodiment has a configuration in which the light block switching section 77 of the image forming apparatus 10 in the second embodiment is replaced by a light block switching section 77A.

Figure 14:
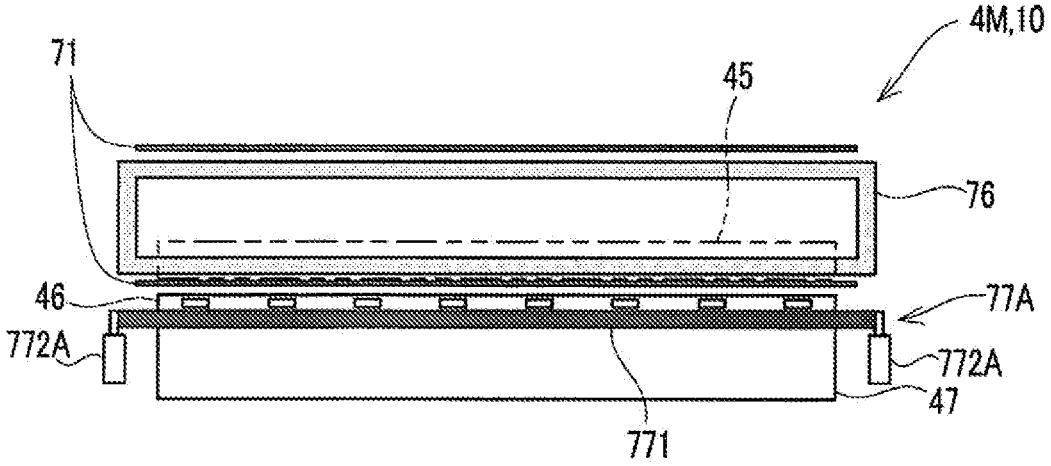
FIG. 14 is a front view of a light block switching section and section therearound in an image forming apparatus according to a third embodiment of the present disclosure.

FIG. 14 is a front view of the light block switching section 77A and section therearound in the image forming apparatus 10. In FIG. 14, the same references are assigned to the same elements as those illustrated in FIGS. 8-13. The following describes differences of the light block switching section 77A of the image forming apparatus 10 in third embodiment compared with the light block switching section 77 of the image forming apparatus 10 in the second embodiment.

The light block switching section 77A includes a light blocking member 771 that blocks light and a shift mechanism 772A that supports the light blocking member 771 and shifts the light blocking member 771. The shift mechanism 772A shifts the light blocking member 771 between a blocking position and a retracted position. Note that FIG. 14 illustrates a state in which the light blocking member 771 is positioned at the retracted position.

For example, the control section 8 controls the shift mechanism 75 that shifts the supporting frame 76 and the shift mechanism 772A that shifts the light blocking member 771 in synchronization. In the configuration as above, in controlling the shift mechanism 75 to be in the color mode, the control section 8 controls the shift mechanism 772A to position the light blocking member 771 at the retracted position. By contrast, in controlling the shift mechanism 75 to be in the monochrome mode, the control section 8 controls the shift mechanism 772A to position the light blocking member 771 at the blocking position.

Even the configuration with the light block switching section 77A can prevent adverse influence of the first static eliminating light L1 from the static eliminating sections 46 on the photosensitive members 41 and production of a defect in image quality caused by turning off of the static eliminating sections 46.

Fourth Embodiment

An image forming apparatus 10 according to a fourth embodiment of the present disclosure will be described with reference to FIGS. 15 and 16. The image forming apparatus 10 according to the fourth embodiment has a configuration in which the light block switching section 77 of the image forming apparatus 10 in the second embodiment is replaced by a light block switching section 77B.

Figure 15:
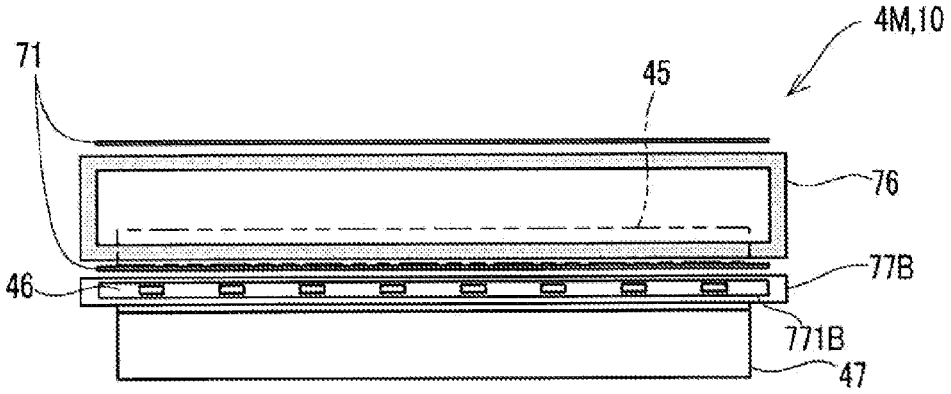
FIG. 15 is a front view of a light block switching section and section therearound in an image forming apparatus in the color mode according to a fourth embodiment of the present disclosure.
Figure 16:
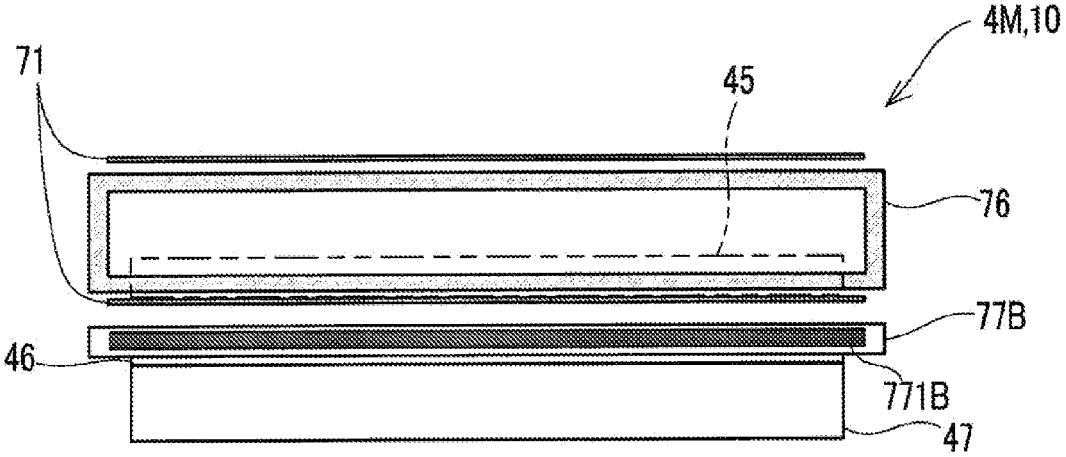
FIG. 16 is a schematic front view of the light block switching section and section therearound in the image forming apparatus in the monochrome mode according to the fourth embodiment of the present disclosure.

FIGS. 15 and 16 each are a front view of the light block switching section 77B and section therearound in the image forming apparatus 10 according to the fourth embodiment. Wherein, FIG. 15 illustrates a state in which the color mode is selected, while FIG. 16 illustrates a state in which the monochrome mode is selected. In FIGS. 15 and 16, the same references are assigned to the same elements as those illustrated in FIGS. 8-14. The following describes differences of the light block switching section 77B of the image forming apparatus 10 in the fourth embodiment when compared with the light block switching section 77 of the image forming apparatus 10 in the second embodiment.

The light block switching section 77B is an optical shutter secured in the middle of the light path of the first static eliminating light L1 in the magenta image forming unit 4M. The light block switching section 77B selectively switches an aperture portion 771B located in the light path of the first static eliminating light L1 between a transparent state in which the first static eliminating light L1 is transmitted and an opaque state in which the first static eliminating light L1 is blocked. The light block switching section 77B may be a liquid crystal shutter, for example.

For example, the control section 8 controls the shift mechanism 75 that shifts the supporting frame 76 and the light block switching section 77B (optical shutter) in synchronization. In the configuration as above, when controlling the shift mechanism 75 to be in the color mode, the control section 8 sets the aperture section 771B of the light block switching section 77B to be in the transparent state. By contrast, when controlling the shift mechanism 75 to be in the monochrome mode, the control section 8 sets the aperture section 771B of the light block switching section 77B to be in the opaque state.

Even the configuration with the light block switching section 77B can prevent adverse influence of the first static eliminating light L1 from the static eliminating sections 46 on the photosensitive members 41 and production of a defect in image quality caused by turning off of the static eliminating sections 46.

Each of the light block switching section 77A in the third embodiment and the light block switching section 77B in the fourth embodiment selectively switches between a blocking state to block the first static eliminating light L1 toward the photosensitive member 41 and a non-blocking state not to block the first static eliminating light L1 theretoward in the magenta image forming unit 4M according to the mode selected between the color mode and the monochrome mode. Note that each of the light block switching sections 77A and 77B is an example of the static elimination exposure switching section.

Fifth Embodiment

Figure 17:
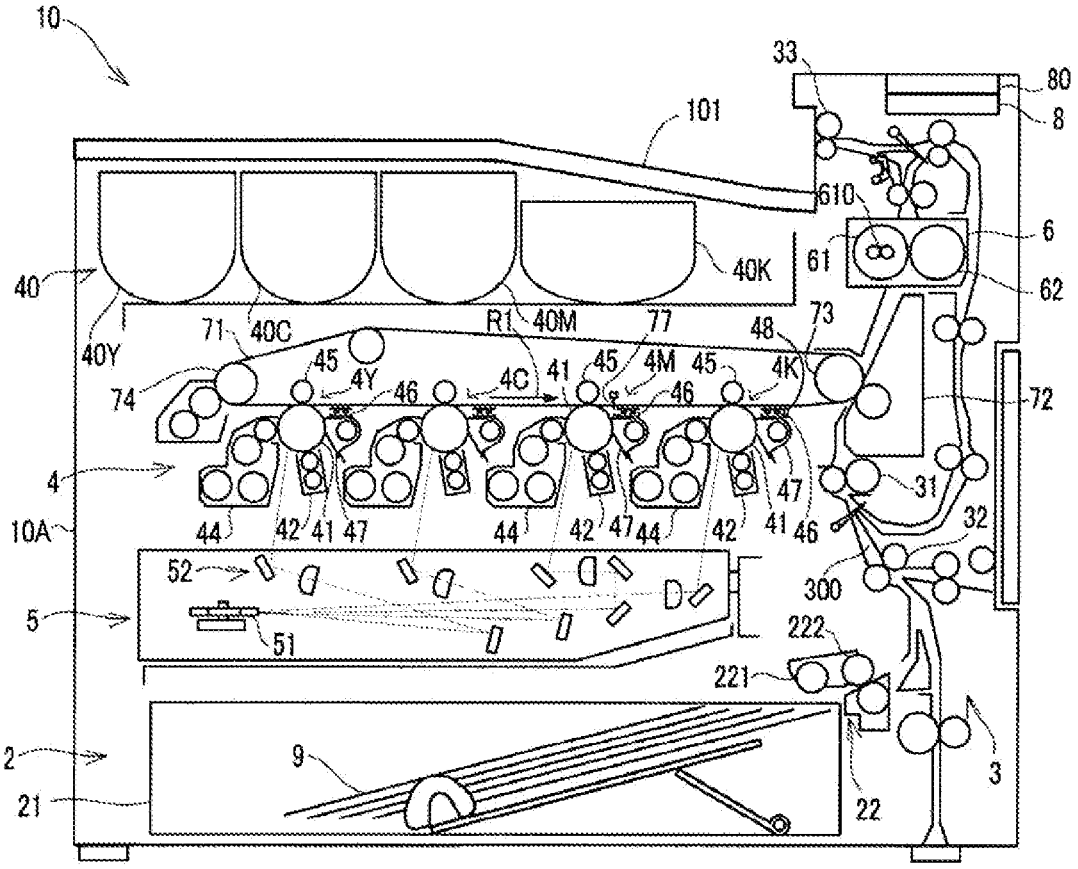
FIG. 17 illustrates a configuration of an image forming apparatus according to a fifth embodiment of the present disclosure.
Figure 20:
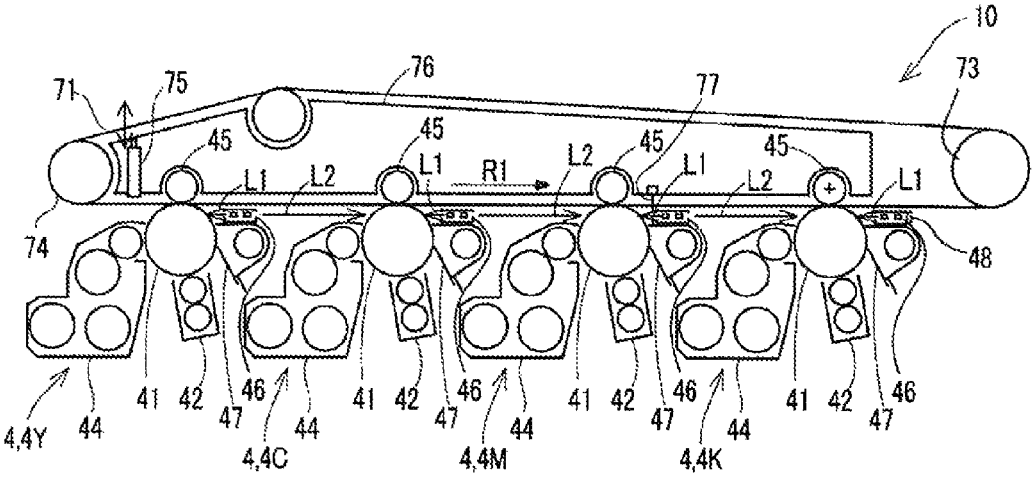
FIG. 20 is a schematic side view of the image forming units and light block switching sections of the image forming apparatus in the color mode according to the fifth embodiment of the present disclosure.
Figure 21:
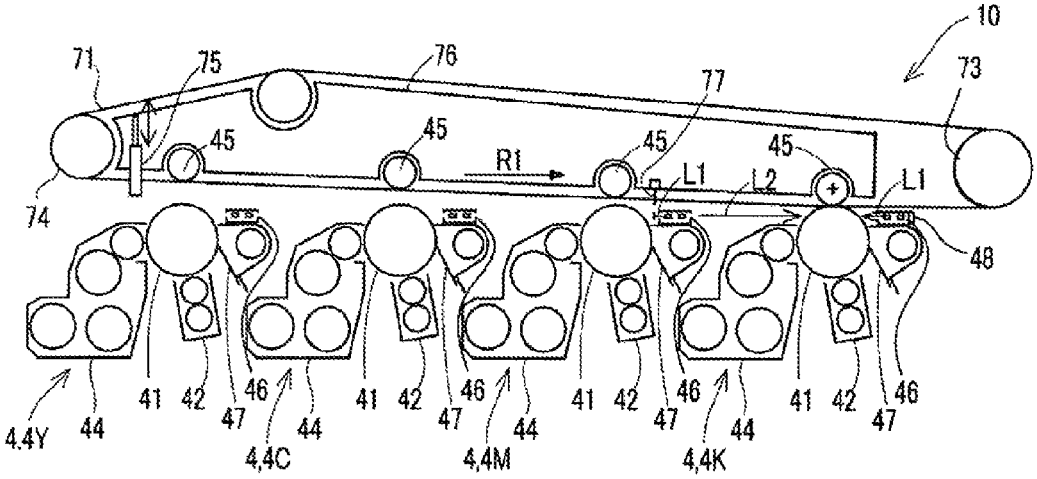
FIG. 21 is a schematic side view of the image forming units and the light block switching sections of the image forming apparatus in the monochrome mode according to the fifth embodiment of the present disclosure.

A configuration of an image forming apparatus 10 according to a fifth embodiment of the present disclosure will be described with reference to FIGS. 17-21. As illustrated in FIG. 17, the image forming apparatus 10 according to the fifth embodiment has the same configuration as the image forming apparatus 10 (see FIG. 8) according to the second embodiment. For example, each of the static eliminating sections 46 in the fifth embodiment has the same configuration as each of the static eliminating sections 46 (see FIG. 9) in the second embodiment. However, as illustrated in FIGS. 17, 20, and 21, the image forming apparatus 10 in the fifth embodiment includes a reflector 48 in addition to the configuration of the image forming apparatus 10 in the second embodiment. FIGS. 20 and 21 each are a schematic side view of all of the image forming units 4 and the intermediate transfer belt 71 of the image forming apparatus 10.

As illustrated in FIGS. 20 and 21, the shift mechanism 75 in the fifth embodiment has the same configuration as the shift mechanism 75 (see FIGS. 10 and 12) in the second embodiment. Specifically, the shift mechanism 75 in the fifth embodiment changes the positional relationship between the intermediate transfer belt 71 and the photosensitive members 41 (image bearing members). The shift mechanism 75 is capable of selectively switching an operating mode of the image forming units 4 between a plurality of modes including a first mode and a second mode by changing the positional relationship. The first and second modes may be referred to as first and second color modes, respectively.

While the color mode is selected by the shift mechanism 75, the control section 8 causes the static eliminating sections 46 of all of the image forming units 4 for the four colors to be turned on. By contrast, while the monochrome mode is selected by the shift mechanism 75, the control section 8 causes the static eliminating section 46 of the black image forming unit 4K, which is operated in the monochrome mode, and the static eliminating section 46 of the magenta image forming unit 4M located upstream next thereto in terms of the belt circulating direction R1 to be turned on and causes the other static eliminating sections 46 to be turned off.

Here, static eliminating sections of image forming units in a typical image forming apparatus may have functions of both post-transfer static elimination and pre-transfer static elimination. Further, the respective static eliminating sections use components common to one another. In the configuration as above, the second static eliminating light output downstream in terms of the belt circulating direction from the static eliminating section of the furthest downstream black image forming unit, which in terms of the belt circulating direction does not function as the pre-transfer static eliminating light. For this reason, the static eliminating section of the black image forming unit may dissipate electric power.

Further, in such a typical image forming apparatus, employment of a static eliminating section that does not output the second static eliminating light (pre-transfer static eliminating light) for only the furthest downstream black image forming unit is contradictory to the need of using common components to the utmost.

By contrast, the image forming apparatus 10 including the reflector 48 can effectively make use of the second static eliminating light L2 in the black image forming unit 4K, as will be described below. Accordingly, in a configuration in which each of the static eliminating sections has functions of both post-transfer static elimination and pre-transfer static elimination, common components can be employed for the static eliminating sections 46 to the utmost and power dissipation can be reduced in the static eliminating section 46 of the black image forming unit 4K located the furthest downstream in terms of the belt circulating direction R1.

The reflector 48 will be described below. The reflector 48 reflects the second static eliminating light L2 in the black image forming unit 4K, which is located the furthest downstream in terms of the belt circulating direction R1 among the image forming units 4, upstream in terms of the belt circulating direction R1. The reflector 48 may be a mirror, metal foil in silver color, or a member coated with a silver paint, for example. Note that the black image forming unit 4K is an example of the furthest downstream image forming unit.

Figure 18:
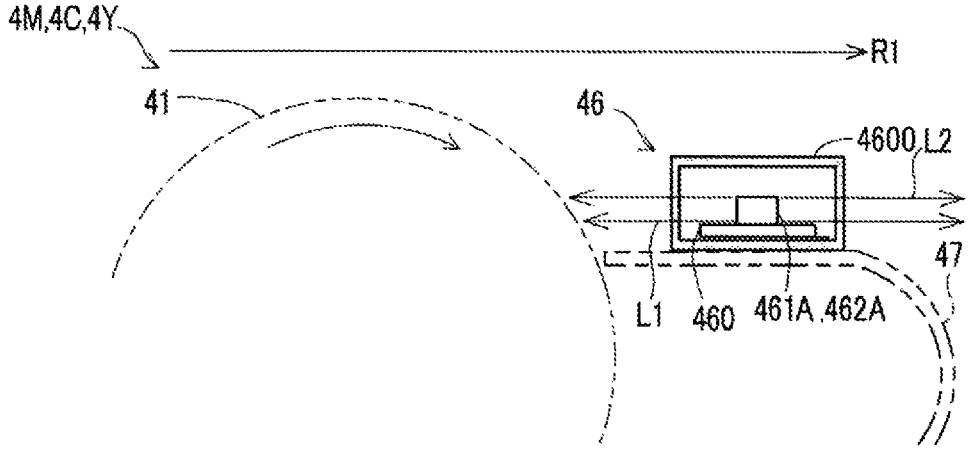
FIG. 18 is a cross sectional view of a static eliminating section and a reflector of an image forming unit other than a black image forming unit in the image forming apparatus according to the fifth embodiment of the present disclosure.
Figure 19:
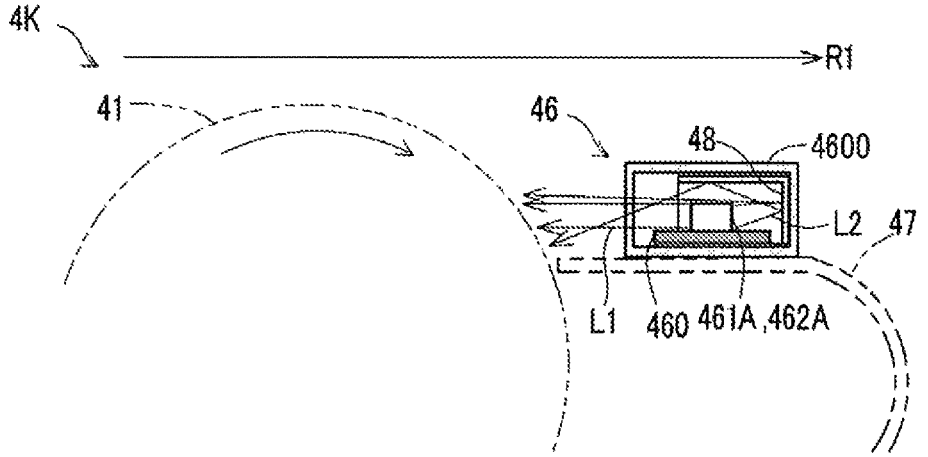
FIG. 19 is a cross sectional view of a static eliminating section and a reflector in the black image forming unit of the image forming apparatus according to the fifth embodiment of the present disclosure.

As illustrated in FIGS. 18 and 19, each of the static eliminating sections 46 in the fifth embodiment includes a transparent cover 4600 that covers the light source 461A that outputs the first and second static eliminating light L1 and L2 and the optical splitter 462A. The cover 4600 is a dust-proof cover for preventing dust like a developer from straying into an optical system of the static eliminating section 46.

Note that FIGS. 18 and 19 each illustrate a part of a photosensitive member 41 and a part of the primary cleaning section 47 with imaginary lines (dashed and double dotted lines). The cover 4600 may be colored and transparent rather than colorless and transparent.

As illustrated in FIG. 18, in each of the image forming units 4 (4M, 4C, 4Y) except the black image forming unit 4K, the first static eliminating light L1 is transmitted through the cover 4600 and exposes a part of the photosensitive member 41 of the image forming unit 4 that has been subjected to image transfer. Similarly, the second static eliminating light L2 is transmitted through the cover 4600 and exposes a part of a next downstream photosensitive member 41 (not illustrated) that has not yet been subjected to image transfer.

By contrast, as illustrated in FIG. 19, in the black image forming unit 4K, the first static eliminating light L1 is transmitted through the cover 4600 and exposes a part of the photosensitive member 41 of the black image forming unit 4K that has been subjected to image transfer. On the other hand, in the black image forming unit 4K, the second static eliminating light L2 is reflected on the reflector 48, travels upstream in terms of the belt circulating direction R1, and is transmitted through the cover 4600, and exposes then a part of the photosensitive member 41 of the black image forming unit 4K that has been subjected to image transfer.

In the example illustrated in FIG. 19, the reflector 48 extends along a surface (inner or outer surface) of the cover 4600. In the configuration as above, the reflector 48 extends along at least a downstream surface of the cover 4600 in terms of the belt circulating direction R1. Further, in a configuration in which the reflector 48 extends along another surface of the cover 4600 in addition except an upstream surface in terms of the belt circulating direction R1, the second static eliminating light L2 can be reflected upstream in terms of the belt circulating direction R1 more efficiently.

Still, extension of the reflector 48 along the surface (inner or outer surface) of the cover 4600 can result in integration of the reflector 48 with the static eliminating section 46 of the black image forming unit 4K. This can result in compact components. For example, the reflector 48 is attached to the surface of the cover 4600.

Note that the reflector 48 extends along the inner surface of the cover 4600 in FIG. 19. Conversely, the reflector 48 may extend along the outer surface of the cover 4600.

Both the first and second static eliminating light L1 and L2 act as the post-transfer static eliminating light in the black image forming unit 4K. As a result, common components can be employed for the static eliminating sections 46 and power dissipation in the black image forming unit 4K located the furthest downstream in terms of the belt circulating direction R1 can be reduced.

The photosensitive member 41 of the furthest downstream black image forming unit 4K preferably has a relative permittivity greater than the photosensitive members 41 of the other of the image forming units 4 in the image forming apparatus 10. For example, the photosensitive member 41 of the black image forming unit 4K (furthest downstream image forming unit) may be made from amorphous silicon (a-Si), while the photosensitive members 41 of the other of the image forming units 4 may be made from organic photoconductor (OPC).

Typically, a photosensitive member made from amorphous silicon has a relative permittivity greater than an organic photosensitive member and more excellent in durability (abrasion resistance) than the organic photosensitive member. However, the photosensitive member made from amorphous silicon, which has a greater relative permittivity, needs to be irradiated with more intense static eliminating light (having greater light quantity) than the organic photosensitive member.

In the image forming apparatus 10 including the reflector 48, the photosensitive member 41 of the black image forming unit 4K is irradiated with the post-transfer static eliminating light that is more intense than that with which the other of the photosensitive members 41 are irradiated. For this reason, even if the light sources 461A are the same in each of the four static eliminating sections 46 and equal electric power is supplied to each of the light sources 461A, static electricity on the photosensitive member 41 of the black image forming unit 4K, which is made from amorphous silicon, can be sufficiently eliminated.

In other words, even if the photosensitive member 41 of the black image forming unit 4K is different from the other, the four static eliminating sections 46 and power supply to them can be common to one another, thereby simplifying the apparatus.

Conversely, all of the photosensitive member 41 may be the same type of photosensitive member. In the configuration as above, power supply to the static eliminating sections 46 of the black image forming unit 4K is reduced when compared with that to the other static eliminating sections 46. By doing so, surplus static eliminating light can be reduce, thereby enabling electric power saving in the static eliminating section 46.

Sixth Embodiment

An image forming apparatus 10 according to a sixth embodiment of the present disclosure will be described next with reference to FIG. 22. The image forming apparatus 10 in the sixth embodiment is different from that in the fifth embodiment in position of the reflector 48.

Figure 22:
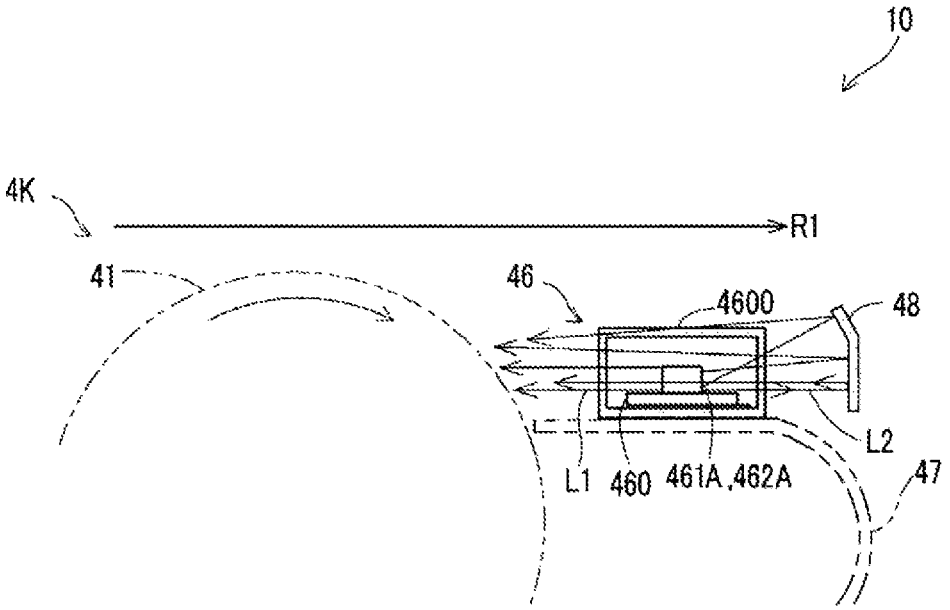
FIG. 22 is a cross sectional view of a static eliminating section and a reflector of a black image forming unit of an image forming apparatus according to a sixth embodiment of the present disclosure.

FIG. 22 is a cross sectional view of the static eliminating section 46 and the reflector 48 of the black image forming unit 4K in the image forming apparatus 10 according to the sixth embodiment. In FIG. 22, the same references are assigned to the same elements as those illustrated in FIGS. 17-21.

The reflector 48 in the image forming apparatus 10 of the fifth embodiment is integral with the cover 4600 in the static eliminating section 46 of the black image forming unit 4K. By contrast, the reflector 48 in the image forming apparatus 10 of the sixth embodiment is secured at a position spaced apart from the static eliminating section 46.

The image forming apparatus 10 including the reflector 48 as illustrated in FIG. 22 has the same advantages as the image forming apparatus 10 in the fifth embodiment.

Seventh Embodiment

An image forming apparatus 10 according to a seventh embodiment of the present disclosure will be described next with reference to FIG. 23. The image forming apparatus 10 in the seventh embodiment has a configuration of the image forming apparatus 10 in the fifth embodiment from which the light block switching section 77 is removed. Further, the static eliminating sections 46 of the image forming apparatus 10 in the seventh embodiment each are different from the static eliminating sections 46 of the image forming apparatus 10 in the fifth embodiment.

Figure 23:
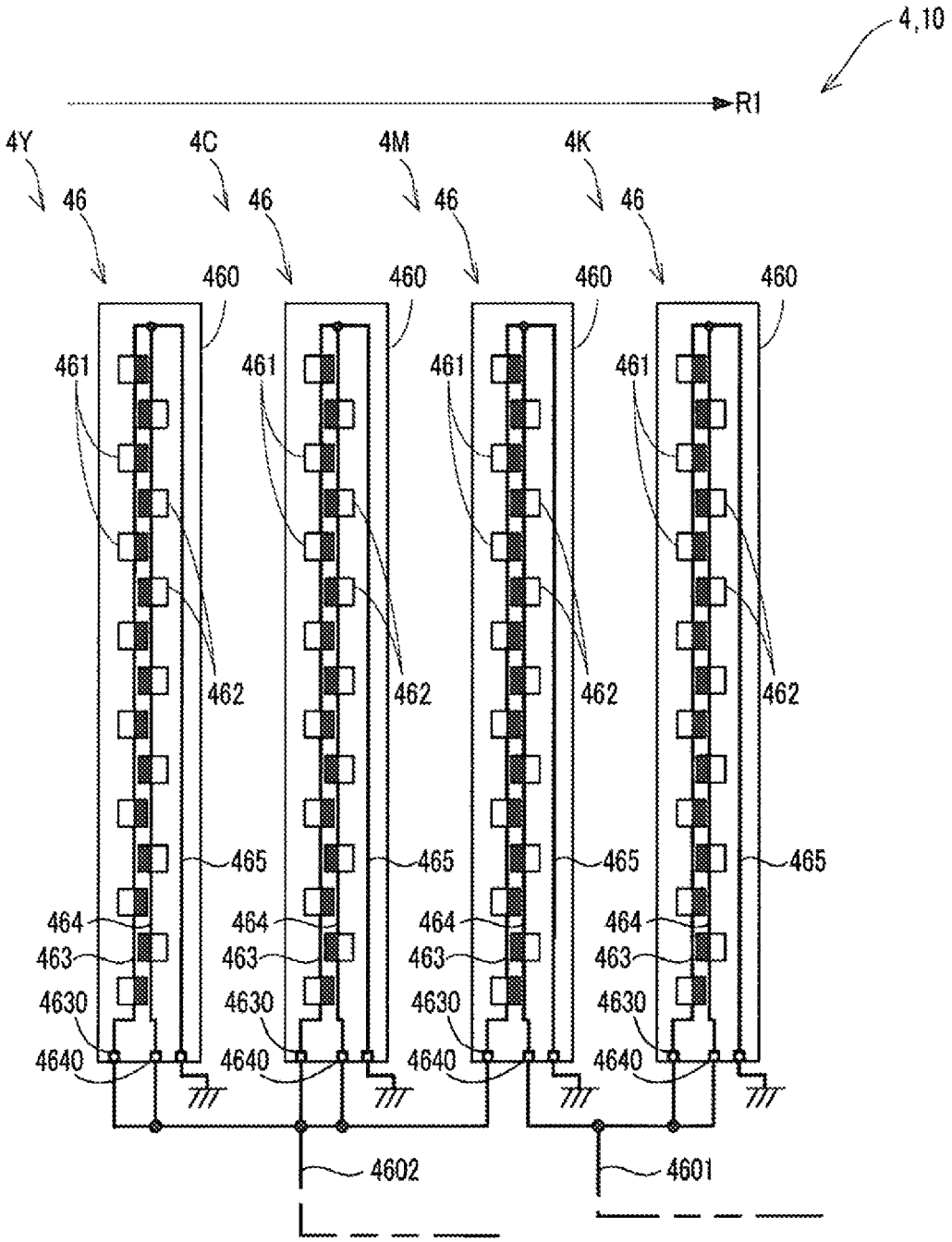
FIG. 23 illustrates a configuration of static eliminating sections in an image forming apparatus according to a seventh embodiment of the present disclosure.

FIG. 23 illustrates a configuration of a static eliminating section 46 in the image forming apparatus 10 according to the seventh embodiment of the present disclosure. In FIG. 23, the same references are assigned to the same elements as those illustrated in FIGS. 17-22. The following describes differences of the static eliminating sections 46 in the image forming apparatus 10 according to the seventh embodiment compared with those in the image forming apparatus 10 according to the fifth embodiment.

As illustrated in FIG. 23, each of the static eliminating sections 46 includes a first static eliminating light source 461 for the first static eliminating light L1 and a second static eliminating light source 462 for the second static eliminating light L2, which are mounted on the substrate 460. The first static eliminating light source 461 outputs the light upstream in terms of the belt circulating direction R1. The second static eliminating light source 462 outputs the light downstream in terms of the belt circulating direction R1.

Each of the static eliminating sections 46 includes a circuit capable of independently turning on and off the first and second static eliminating light sources 461 and 462. The first and second static eliminating light sources 461 and 462 each include a plurality of light emitting diodes or the like arranged in terms of the axial direction of the photosensitive member 41, for example.

A first power supply line 463, a second power supply line 464, and a ground line 465 run on each of the substrates 460 of the static eliminating sections 46.

The first power supply line 463 is provided for the first static eliminating light source 461. The second power supply line 464 is provided for the second static eliminating light source 462. A first terminal 4630 serving as a connection terminal of the first power supply line 4633 and a second terminal 4640 serving as a connection terminal of the second power supply line 464 are provided independently on the substrate 460. The ground line 465 connects the first and second power supply lines 463 and 464 to a grounded reference potential section.

A first drive line 4601 for static elimination is electrically connected to the first and second power supply lines 463 and 464 in the static eliminating section 46 of the black image forming unit 4K and the second power supply line 464 in the static eliminating section 46 of the next magenta image forming unit 4M. A second drive line 4602 for static elimination is electrically connected to the first power supply line 463 in the static eliminating section 46 of the magenta image forming unit 4M and the first and second static eliminating light sources 461 and 462 in the other of the image forming units 4 except the black and magenta image forming units 4K and 4M.

In other words, light source drive lines for the four static eliminating sections 46 are grouped into two lines of the first and second drive lines 4601 and 4602 for static elimination.

While the color mode is selected, the control section 8 outputs the light source drive signals to both the first and second drive lines 4601 and 4602 for static elimination. In the configuration as above, both post-transfer static elimination and pre-transfer static elimination are performed in all of the image forming units 4 for the four colors.

By contrast, while the monochrome mode is selected, the control section 8 outputs the light source drive signals to only the first drive line 4601 for static elimination and does not output them to the second drive line 4602 for static elimination. In the configuration as above, post-transfer static elimination and pre-transfer static elimination are performed only in the black image forming unit 4K.

Further, while the monochrome mode is selected, the first static eliminating light source 461 in the magenta image forming unit 4M is turned off. The configuration as above can prevent adverse influence of the first static eliminating light L1 on the photosensitive member 41 of the magenta image forming unit 4M that is being stopped.

Other Application Examples

In any of the image forming apparatuses 10 in the first to seventh embodiments as described above, the magenta image forming unit 4M and the cyan image forming unit 4C may be arranged in an inverse order in terms of the belt circulating direction R1.

For example, the first mode may be a mode in which all of the image forming units 4 for the four colors are operated, while the second mode may a mode in which two or three image forming units 4 counting from the furthest downstream image forming unit 4 in terms of the belt circulating direction R1 are operated. In such a configuration, for example, in the image forming apparatus 10 in the first or seventh embodiment, the first and second power supply lines 463 and 464 are grouped into the first and second drive lines 4601 and 4602 for static elimination by demarcation between the first and second power supply lines 463 and 464 in an image forming unit 4 located the furthest downstream in terms of the belt circulating direction R1 among the image forming unit(s) 4 of which operation is stopped in the second mode.

What is claimed is:

1. An image forming apparatus including an endless intermediate transfer belt that circulates and a plurality of image forming units arranged along the intermediate transfer belt, the image forming units each including an image bearing member, a development section that develops an electrostatic latent image on a surface of the image bearing member, a primary transfer section that transfers an image to the intermediate transfer belt, and a cleaning section that cleans the surface of the image bearing member, image forming units forming respective images in different colors on a surface of the intermediate transfer belt in a superimposed manner, the image forming apparatus comprising:

a plurality of static eliminating sections each provided in a corresponding one of the image forming units and each configured to output first static eliminating light and second static eliminating light from between the primary transfer section and the cleaning section, the first static eliminating light traveling upstream in terms of a circulation direction of the intermediate transfer belt, the second static eliminating light traveling downstream in terms of the circulation direction of the intermediate transfer belt;

a mode switching section that selectively switches a state of the image forming units among a plurality of modes including a first mode and a second mode, the first mode being a state in which all of the image forming units are operated, the second mode being a state in which only a portion of the image forming units is operated, the portion of the image forming units being at least one first image forming unit located on a downstream side in terms of the circulation direction of the intermediate transfer belt among the image forming units; and a static elimination exposure switching section that in a second image forming unit located upstream next to the first image forming unit in terms of the circulation direction of the intermediate transfer belt among the image forming units, causes the image bearing member of the second image forming unit to be irradiated with the first static eliminating light and causes the image bearing member of the first image forming unit to be irradiated with the second static eliminating light while the first mode is selected, and causes the image bearing member of the second image forming unit not to be irradiated with the first static eliminating light and causes the image bearing member of the first image forming unit to be irradiated with the second static eliminating light while the second mode is selected, wherein each of the static eliminating sections includes:

a first static eliminating light source that outputs the first static eliminating light; and a second static eliminating light source that outputs the second static eliminating light, and the static elimination exposure switching section causes the first static eliminating light source of the first image forming unit and the first and second static eliminating light sources of all of the other of the image forming units to be turned on while the first mode is selected, and causes the first static eliminating light source of the first image forming unit and the second static eliminating light source of the second image forming unit to be turned on and causes the first and second static eliminating light sources of all of the other of the image forming units except the first and second image forming units to be turned off while the second mode is selected.

2. The image forming apparatus according to claim 1, further comprising:

a first drive line for static elimination electrically connected to the first static eliminating light source of the first image forming unit and the second static eliminating light source of the second image forming unit; and a second drive line for static elimination electrically connected to the first static eliminating light source of the second image forming unit and the first and second static eliminating light sources of all of the other of the image forming units except the first and second image forming units, wherein the static elimination exposure switching section outputs a light source drive signal to each of the first and second drive lines for static elimination while the first mode is selected, and outputs the light source drive signal to only the first drive line for static elimination while the second mode is selected.

3. The image forming apparatus according to claim 1, wherein the static elimination exposure switching section causes the second static eliminating light source of the first image forming unit not to be turned on regardless of whether the first or second mode is selected.

4. An image forming apparatus according to claim 1, wherein a yellow image forming unit among the image forming units is located furthest upstream in terms of the circulation direction of the intermediate transfer belt.

5. An image forming apparatus including an endless intermediate transfer belt that circulates and a plurality of image forming units arranged along the intermediate transfer belt, the image forming units each including an image bearing member, a development section that develops an electrostatic latent image on a surface of the image bearing member, a primary transfer section that transfers an image to the intermediate transfer belt, and a cleaning section that cleans the surface of the image bearing member, image forming units forming respective images in different colors on a surface of the intermediate transfer belt in a superimposed manner, the image forming apparatus comprising:

a plurality of static eliminating sections each provided in a corresponding one of the image forming units and each configured to output first static eliminating light and second static eliminating light from between the primary transfer section and the cleaning section, the first static eliminating light traveling upstream in terms of a circulation direction of the intermediate transfer belt, the second static eliminating light traveling downstream in terms of the circulation direction of the intermediate transfer belt;

a mode switching section that selectively switches a state of the image forming units among a plurality of modes including a first mode and a second mode, the first mode being a state in which all of the image forming units are operated, the second mode being a state in which only a portion of the image forming units is operated, the portion of the image forming units being at least one first image forming unit located on a downstream side in terms of the circulation direction of the intermediate transfer belt among the image forming units; and a static elimination exposure switching section that in a second image forming unit located upstream next to the first image forming unit in terms of the circulation direction of the intermediate transfer belt among the image forming units, causes the image bearing member of the second image forming unit to be irradiated with the first static eliminating light and causes the image bearing member of the first image forming unit to be irradiated with the second static eliminating light while the first mode is selected, and causes the image bearing member of the second image forming unit not to be irradiated with the first static eliminating light and causes the image bearing member of the first image forming unit to be irradiated with the second static eliminating light while the second mode is selected, wherein the static elimination exposure switching section is a light block switching section that does not block the first static eliminating light toward the image bearing member in the second image forming unit while the first mode is selected, and blocks the first static eliminating light toward the image bearing member in the second image forming unit while the second mode is selected.

6. The image forming apparatus according to claim 5, wherein the light block switching section includes a light blocking member that shifts between a position to block a light path of the first static eliminating light and a position not to block the light path of the first static eliminating light in the second image forming unit.

7. The image forming apparatus according to claim 5, wherein the mode switching section includes a shift mechanism capable of switching the state of the image forming units between the first mode and the second mode by changing a positional relationship between the intermediate transfer belt and the image bearing members, the image bearing members of all of the image forming units being in contact with the intermediate transfer belt in the first mode, the image bearing member of only the first image forming unit being in contact with the intermediate transfer belt in the second mode, and the light block switching section includes a light blocking member that shifts in the second image forming unit between a position to block a light path of the first static eliminating light and a position not to block the light path thereof in association with movement of the shift mechanism of the mode switching section.

8. The image forming apparatus according to claim 5, wherein the light block switching section is an optical shutter that is secured in a light path of the first static eliminating light in the second image forming unit and that selectively switches between a state that allows the first static eliminating light to be transmitted and a state that blocks the first static eliminating light.

9. The image forming apparatus according to claim 5, wherein a yellow image forming unit among the image forming units is located the furthest upstream in terms of the circulation direction of the intermediate transfer belt.

10. An image forming apparatus including an endless intermediate transfer belt that circulates and a plurality of image forming units arranged along the intermediate transfer belt, the image forming units each including an image bearing member, a development section that develops an electrostatic latent image on a surface of the image bearing member, a primary transfer section that transfers an image to the intermediate transfer belt, and a cleaning section that cleans the surface of the image bearing member, the image forming units forming respective images in different colors on a surface of the intermediate transfer belt in a superimposed manner, the image forming apparatus comprising:

a plurality of static eliminating sections each provided in a corresponding one of the image forming units and each configured to output first static eliminating light and second static eliminating light from between the primary transfer section and the cleaning section, the first static eliminating light traveling upstream in terms of a circulation direction of the intermediate transfer belt, the second static eliminating light traveling downstream in terms of the circulation direction of the intermediate transfer belt; and a reflector configured to reflect the second static eliminating light in a furthest downstream image forming unit upstream in terms of the circulation direction of the intermediate transfer belt, the furthest downstream image forming unit being an image forming unit located the furthest downstream in terms of the circulation direction of the intermediate transfer belt among the image forming units, wherein the image bearing member of the furthest downstream image forming unit has a relative permittivity greater than the image bearing members of the other of the image forming units.

11. The image forming apparatus according to claim 10, further comprising a mode switching section that selectively switches a state of the image forming units among a plurality of modes including a first mode and a second mode, the first mode being a state in which all of the image forming units are operated, the second mode being a state in which only the furthest downstream image forming unit is operated among the image forming units.

12. The image forming apparatus according to claim 10, wherein each of the static eliminating sections includes a transparent cover that covers a light source of the first and second static eliminating lights, and the reflector is formed along a surface of the transparent cover.

13. The image forming apparatus according to claim 10, wherein each of the static eliminating sections includes a common light source for the first and second static eliminating lights.

14. The image forming apparatus according to claim 10, wherein a yellow image forming unit among the image forming units is located the furthest upstream in terms of the circulation direction of the intermediate transfer belt.

15. An image forming apparatus including an endless intermediate transfer belt that circulates and a plurality of image forming units arranged along the intermediate transfer belt, the image forming units each including an image bearing member, a development section that develops an electrostatic latent image on a surface of the image bearing member, a primary transfer section that transfers an image to the intermediate transfer belt, and a cleaning section that cleans the surface of the image bearing member, image forming units forming respective images in different colors on a surface of the intermediate transfer belt in a superimposed manner, the image forming apparatus comprising:

a plurality of static eliminating sections each provided in a corresponding one of the image forming units and each configured to output first static eliminating light and second static eliminating light from between the primary transfer section and the cleaning section, the first static eliminating light traveling upstream in terms of a circulation direction of the intermediate transfer belt, the second static eliminating light traveling downstream in terms of the circulation direction of the intermediate transfer belt; and a reflector configured to reflect the second static eliminating light in a furthest downstream image forming unit upstream in terms of the circulation direction of the intermediate transfer belt, the furthest downstream image forming unit being an image forming unit located the furthest downstream in terms of the circulation direction of the intermediate transfer belt among the image forming units, wherein the image bearing member of the furthest downstream image forming unit is a photosensitive member made from amorphous silicon, and the image bearing members of the other of the image forming units are organic photosensitive members.

16. The image forming apparatus according to claim 15, further comprising a mode switching section that selectively switches a state of the image forming units among a plurality of modes including a first mode and a second mode, the first mode being a state in which all of the image forming units are operated, the second mode being a state in which only the furthest downstream image forming unit is operated among the image forming units.

17. The image forming apparatus according to claim 15, wherein each of the static eliminating sections includes a transparent cover that covers a light source of the first and second static eliminating lights, and the reflector is formed along a surface of the transparent cover.

18. The image forming apparatus according to claim 15, wherein each of the static eliminating sections includes a common light source for the first and second static eliminating lights.

19. The image forming apparatus according to claim 15, wherein a yellow image forming unit among the image forming units is located the furthest upstream in terms of the circulation direction of the intermediate transfer belt.

* * * * *